US012025401B2

(12) United States Patent
Summers et al.

(10) Patent No.: US 12,025,401 B2
(45) Date of Patent: Jul. 2, 2024

(54) ARCHERY ACCESSORY GUARD AND METHOD

(71) Applicant: QTM, LLC, Madison Heights, VA (US)

(72) Inventors: Daniel A. Summers, Alpine, WY (US); Kevin S. Fry, Monroe, VA (US); Jason T. Lynch, Rustburg, VA (US)

(73) Assignee: QTM, LLC, Madison Heights, VA (US)

( * ) Notice: Subject to any disclaimer, the term of this patent is extended or adjusted under 35 U.S.C. 154(b) by 0 days.

(21) Appl. No.: 17/887,750

(22) Filed: Aug. 15, 2022

(65) Prior Publication Data

US 2023/0050304 A1 Feb. 16, 2023

Related U.S. Application Data

(60) Provisional application No. 63/233,000, filed on Aug. 13, 2021.

(51) Int. Cl.
*F41B 5/22* (2006.01)
*F41B 5/14* (2006.01)

(52) U.S. Cl.
CPC ..... *F41B 5/1442* (2013.01); *F41B 5/143* (2013.01)

(58) Field of Classification Search
CPC ..... F41B 5/10; F41B 5/14; F41B 5/143
See application file for complete search history.

(56) References Cited

U.S. PATENT DOCUMENTS

| | | | | |
|---|---|---|---|---|
| 4,879,988 | A * | 11/1989 | Larson | F41B 5/143 124/88 |
| 4,979,488 | A * | 12/1990 | Fenton | F41B 5/1403 124/88 |
| 5,022,378 | A * | 6/1991 | Rhodehouse | F41B 5/143 124/44.5 |
| 5,676,121 | A | 10/1997 | Bizier | |
| 7,730,883 | B2 * | 6/2010 | Lawson | F41B 5/14 124/25.6 |
| 7,975,680 | B1 * | 7/2011 | Montgomery | F41B 5/143 124/44.5 |
| 8,671,924 | B2 * | 3/2014 | Hpward | F41B 5/105 124/86 |
| 9,459,070 | B2 * | 10/2016 | Camille | F41B 5/148 |
| 10,859,339 | B2 | 12/2020 | Summers et al. | |
| 2021/0254923 | A1 | 8/2021 | Summers et al. | |

OTHER PUBLICATIONS

Arrow Rest with Retaining Bar; Dated on or before Aug. 17, 2021.

* cited by examiner

*Primary Examiner* — John A Ricci
(74) *Attorney, Agent, or Firm* — Barclay Damon LLP

(57) ABSTRACT

An archery accessory guard and method are disclosed herein. The archery accessory guard, in an embodiment, includes a coupler and a body coupled to the coupler. The coupler is attachable to a support. The body is configured to at least partially guard an archery accessory element that has a front element surface, a rear element surface, and an element part. The body has at least one body surface configured to at least partially face toward the front element surface or the rear element surface. The archery accessory guard is configured to maintain a gap between the body and the element part. The body is configured to receive a force directed toward the element part and then transmit the force to the support.

32 Claims, 27 Drawing Sheets

(PRIOR ART: U.S. Patent No. 5,676,121)

ARCHERY ACCESSORY GUARD AND METHOD

CROSS-REFERENCE TO RELATED APPLICATION

This application is a non-provisional of, and claims the benefit and priority of, U.S. Provisional Patent Application No. 63/233,000 filed on Aug. 13, 2021. The entire contents of such application are hereby incorporated herein by reference.

INCORPORATION BY REFERENCE

The entire contents of the following are hereby incorporated into this application by reference: (a) U.S. patent application Ser. No. 16/682,416, published as U.S. Patent Application Publication No. US 2020/0149838 (now U.S. Pat. No. 10,859,339); and (b) U.S. Patent Application No. 62/978,550 and the non-provisional application claiming priority thereto, U.S. patent application Ser. No. 17/179,986, published as U.S. Patent Application Publication No. US 2021/0254923.

BACKGROUND

There are various types of archery accessories available for compound bows and other types of archery bows. Some of these accessories have delicate or hazardous parts that are exposed. Because they are exposed, these parts are vulnerable to being damaged before and after shooting. Also, these parts can cause harm and damage to people and things.

For example, arrow rest accessories have an arrow engagement part that holds the arrow as the archer aims at a target. When users transport and handle bows, this arrow engagement part can be bent, worn or damaged. Also, this arrow engagement part can scratch, poke or cut people, cases, bags, vehicles and other things when users transport bows. Furthermore, if this arrow engagement part becomes damaged or partially broken, it can be a hazard to archers and bystanders. For example, a broken piece of this part can become airborne and injure a person.

Referring to FIG. 1, a known arrow rest 1 has a retaining bar 3. In use, the archer inserts an arrow 5 into the travel space 7 and sets the arrow 5 onto the arrow holder 9. Were it not for the retaining bar 3, if the archer were to tilt the bow (not shown) too much while walking or climbing, for example, the arrow 5 could fall entirely off of the bow. The retaining bar 3 is designed to prevent the arrow 5 from falling off of the bow. The retaining bar 3 is designed, configured and intended to remain mounted to the arrow rest 1 before, during and after shooting. This is the reason for so much space 7 between the arrow holder 9 and the retaining bar 3. When the archer releases the bowstring (not shown), the bowstring will launch the arrow 5 forward along the Z axis. During this archery activity mode (specifically, the shooting mode) of the arrow rest 1, the travel space 7 enables the arrow 5 to pass through the arrow rest 1 without any contact with or interference from the retaining bar 3. Accordingly, the retaining bar 3 remains attached to the arrow rest 1 during the archery activity mode. Due, in part, to the great amount of space 7 and the shape of the retaining bar 3, the retaining bar 3 is not positioned, configured or dimensioned to safeguard the arrow holder 9 from undesirable impact or contact with objects.

As illustrated in FIG. 2, fork tamers 10 (tubes) are slipped onto the ends 16 of the prongs 14 of the arrow rest 15, as disclosed in FIG. 2 of U.S. Pat. No. 5,676,121. The fork tamers 10 are intended to reduce undesirable noise during shooting. The fork tamers 10 make contact with, and hold, the arrow 18 as the arrow 18 slides forward along the Z axis. After the bow launches the arrow 18, the prongs 14 pivot downward and disengage the arrow 18 so that the fork tamers 10 cause no drag on the flight of the arrow 18. The fork tamers 10 are designed, configured and intended to remain mounted to the arrow rest 15 before, during and after shooting. When the archer releases the bowstring (not shown), the bowstring will launch the arrow 18 forward along the Z axis. During this archery activity mode (specifically, the shooting mode) of the arrow rest 15, the arrow 18 at least momentarily slides along the fork tamers 10. Accordingly, the fork tamers 10 are not intended to be removed from the arrow rest 15 before the archery activity mode begins. Furthermore, the fork tamers 10 are not positioned, shaped or dimensioned to safeguard the prongs 14 from undesirable impact from objects. For example, if an environmental object 32, such as a tree branch, an equipment bag or a person's arm, were to move toward the ends 16 of the prongs 14, the environmental object 32 would strike the ends 16 or the fork tamers 10 that cover the ends 16. The undesirable force 34 would transmit either directly to the ends 16 or directly to the fork tamers 10, in which case, the fork tamers 10 would then transmit the undesired force 34 to ends 16. Accordingly, this undesirable force 34, if great enough, would cause the ends 16 or prongs 14 to bend, deform or otherwise become damaged.

The foregoing background describes some, but not necessarily all, of the problems, disadvantages and shortcomings related to the known weaponry and archery accessories.

SUMMARY

In an embodiment, an archery accessory guard includes a coupler and a body coupled to the coupler. The coupler is configured to be removably attached to the support. The body is configured to at least partially guard an archery accessory element. The archery accessory element includes a front element face, a rear element face, a plurality of element sides, and an element part. The body has a first guard surface configured to at least partially face toward the front element face or the rear element face. Also, the body has a second guard surface configured to at least partially cover the element part while being spaced apart from the element part by a gap. The coupler and the body are configured so that, when they are coupled to the support: (a) the second guard surface is spaced apart from the element part by the gap; (b) the body at least partially obstructs access to the archery accessory element; (c) the body is configured to receive a force directed toward the element part; and (d) the body is configured to transmit the force to the support.

In another embodiment, the archery accessory guard includes a coupler and a body coupled to the coupler. The coupler is attachable to a support. The body is configured to at least partially guard an archery accessory element that includes a front element surface, a rear element surface, and an element part. The body includes a body surface configured to at least partially face toward at least the front element surface or the rear element surface. The coupler and the body are configured so that, when they are coupled to the support: (a) there is a gap between the body and the element part; (b) the body is configured to receive a force directed toward the element part; and (c) the body is configured to transmit the force to the support.

In yet another embodiment, a method for manufacturing an archery accessory guard includes the following steps: configuring a coupler to be attachable to a support; and configuring a body to at least partially guard an archery accessory element that includes a front element surface, a rear element surface, and an element part. The body includes a body surface configured to at least partially face toward at least the front element surface or the rear element surface. The steps also include coupling the body to the coupler. The coupler and the body are configured so that, when they are coupled to the support: there is a gap between the body and the element part; the body is configured to receive a force directed toward the element part; and the body is configured to transmit the force to the support.

Additional features and advantages of the present disclosure are described in, and will be apparent from, the following Brief Description of the Drawings and Detailed Description.

DETAILED DESCRIPTION

Throughout this disclosure set forth herein, the word "including" indicates or means "including, without limitation," the word "includes" indicates or means "includes, without limitation," the phrases "such as" and "e.g." indicate or mean "including, without limitation," and the phrase "for example" refers to a non-limiting example.

Figure 1:
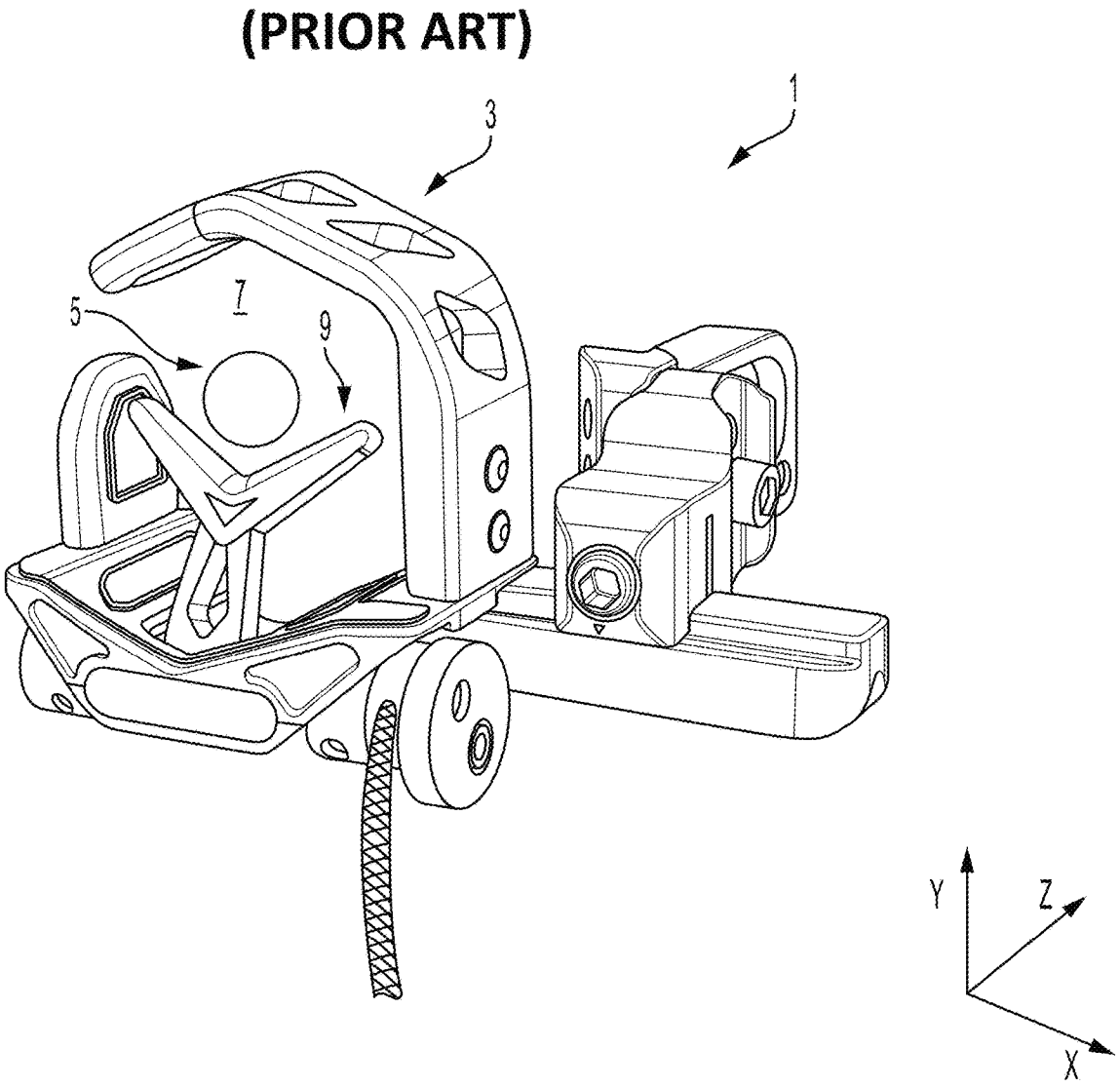
FIG. 1 is a rear isometric view of a known, prior art arrow rest having a retaining bar.
Figure 2:
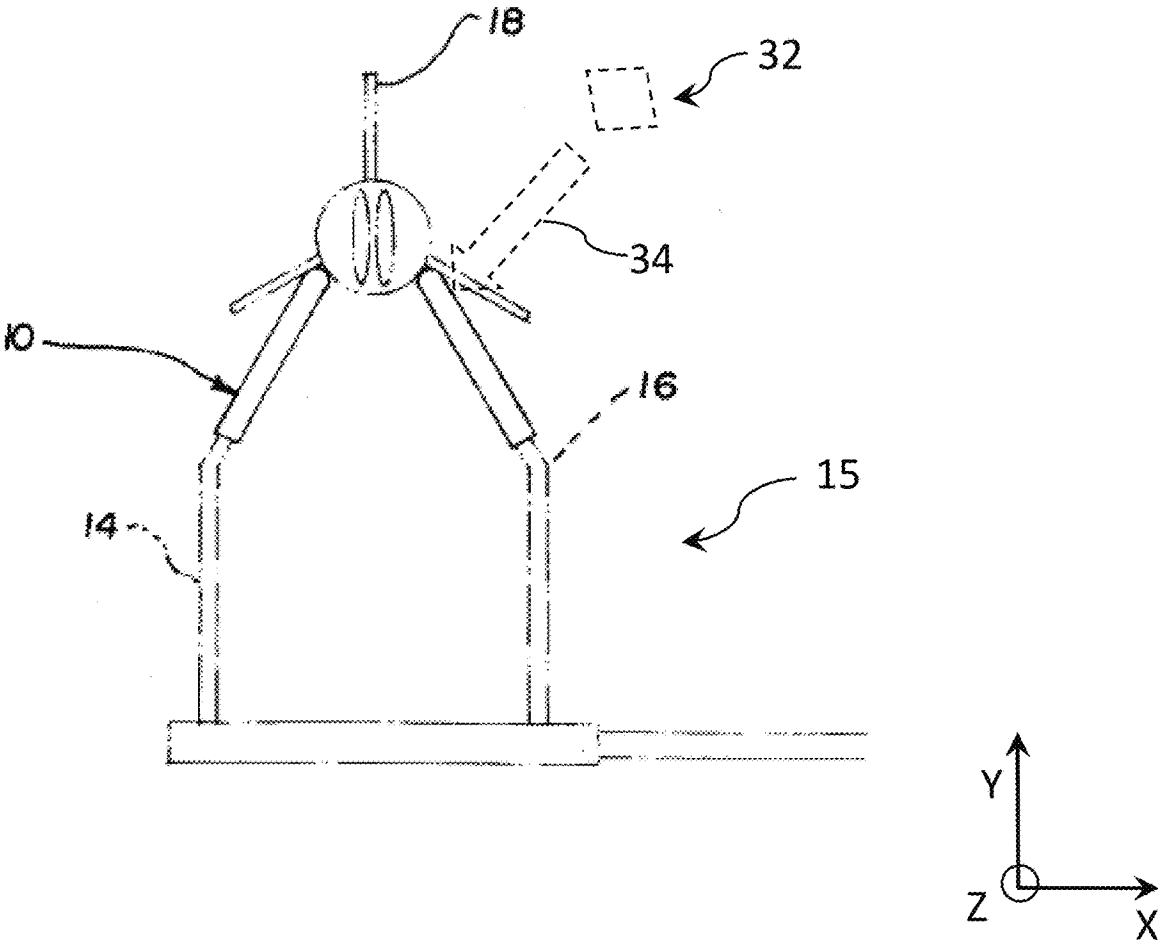
FIG. 2 is the top plan view of a known, prior art fork tamer, reproduced from figure two of U.S. Pat. No. 5,676,121.
Figure 3:
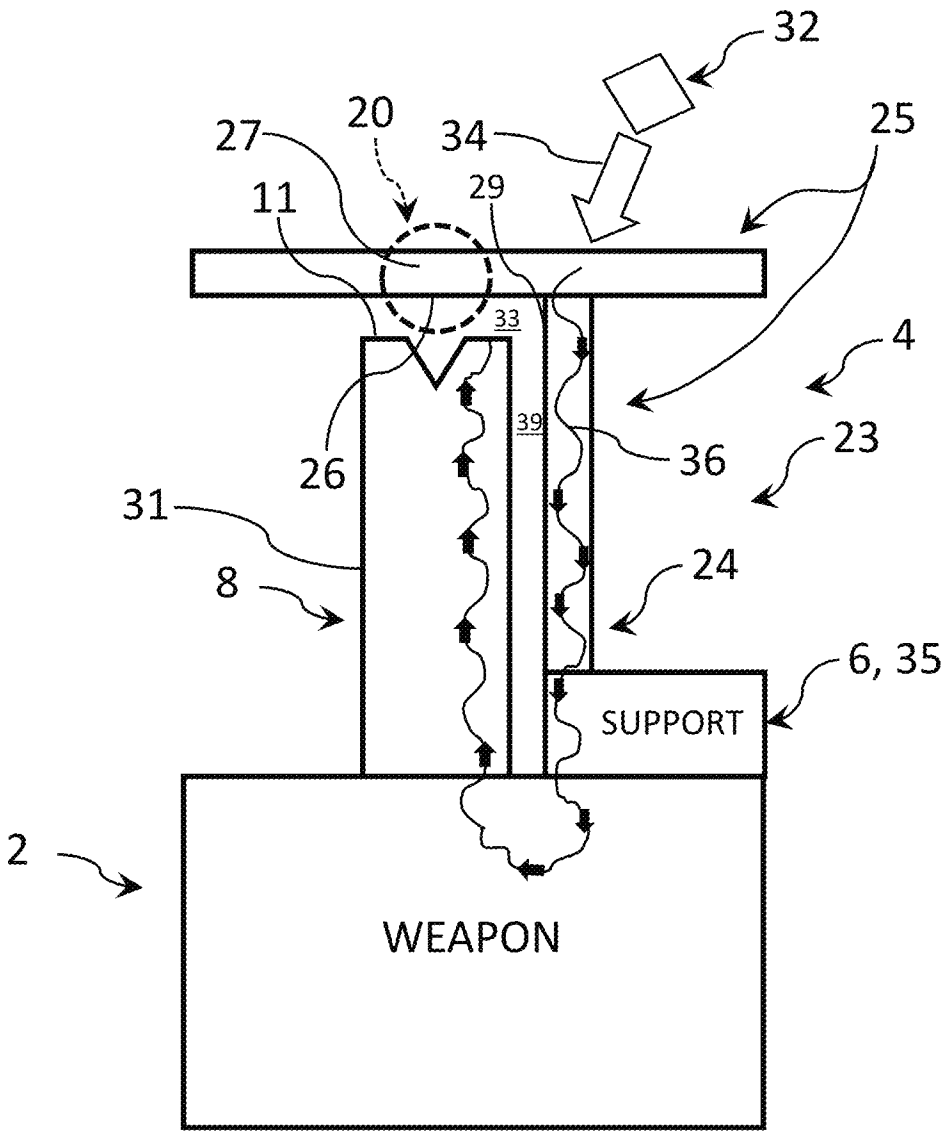
FIG. 3 is a side view of an embodiment of an accessory guard.

Referring to FIG. 3, an accessory element 8 is supported by, connectable to, connected to, or integral with, a weapon 2. In an embodiment, the accessory element 8 is removably attached to the weapon 2. The accessory element 8 is configured to physically contact and engage a weaponry object 20. Depending on the type of the accessory element 8, the weaponry object 20 can be: (a) an arrow, a bolt or another type of projectile; (b) a cord, a cable or a string; or (c) any other type of archery-related object or weaponry-related object. In an embodiment, the accessory element 8 includes an archery accessory element.

In an embodiment, the accessory element 8 is a component or portion of a weaponry accessory, such as an arrow rest, arrow support, power cable controller, power cable guard, sight device, stabilizer, quiver, flashlight device, scope device, laser device, thermal optical device, or any combination of the foregoing. In an embodiment, the accessory element 8 is a disposable or replaceable part of any such weaponry accessory. When such accessory element 8 becomes worn or reaches its end of life, a user can remove such accessory element 8 from the weapon 2 and replace such accessory element 8 with a new one.

In an embodiment, the accessory element 8 includes an element part 11, such as a point, edge, tip or other member. Depending on the embodiment, the element part 11 can be integral with the accessory element 8, or the element part 11 can be detachable from the accessory element 8. The element part 11 can be particularly prone to damage, wear and tear or being injurious or harmful to people or environmental items.

In an embodiment, an accessory guard 4 is configured to be removably coupled to an archery member or support 6. Depending on the embodiment, the accessory guard 4 can include a weapon accessory guard, such as an archery accessory guard. Depending on the embodiment, the support 6 can be a portion of the weapon 2, such as a weapon component or a structure unitary with or integral with the weapon 2. Alternatively, the support 6 can be a part of a weaponry accessory that is mounted to the weapon 2.

As shown in FIG. 3, in an embodiment, the accessory guard 4 includes: (a) a securement, connector, mount or coupler 24 configured to be removably coupled, attached or mounted to the support 6; and (b) a cover, shield, blocker, arm, frame, extension or body 25 connected or otherwise coupled to the coupler 24. When the coupler 24 is connected or secured to the support 6, the coupler 24 has a securement condition 23 in which the coupler 24 is fixedly secured to the support 6, which, in turn, is a part of or fixedly secured to the weapon 2. In an embodiment, the accessory guard 4 includes a snap fit, press fit or friction fit configuration or securement that is suitable to removably attach or removably connect the coupler 24 to the support 6. In another embodiment, the accessory guard 4 includes a fastener, such as a screw or bolt, that connects or secures the coupler 24 to the support 6. As described below, the body 25 safeguards the accessory element 8 against damage, isolating the accessory element 8 from undesirable impact.

Figure 4:
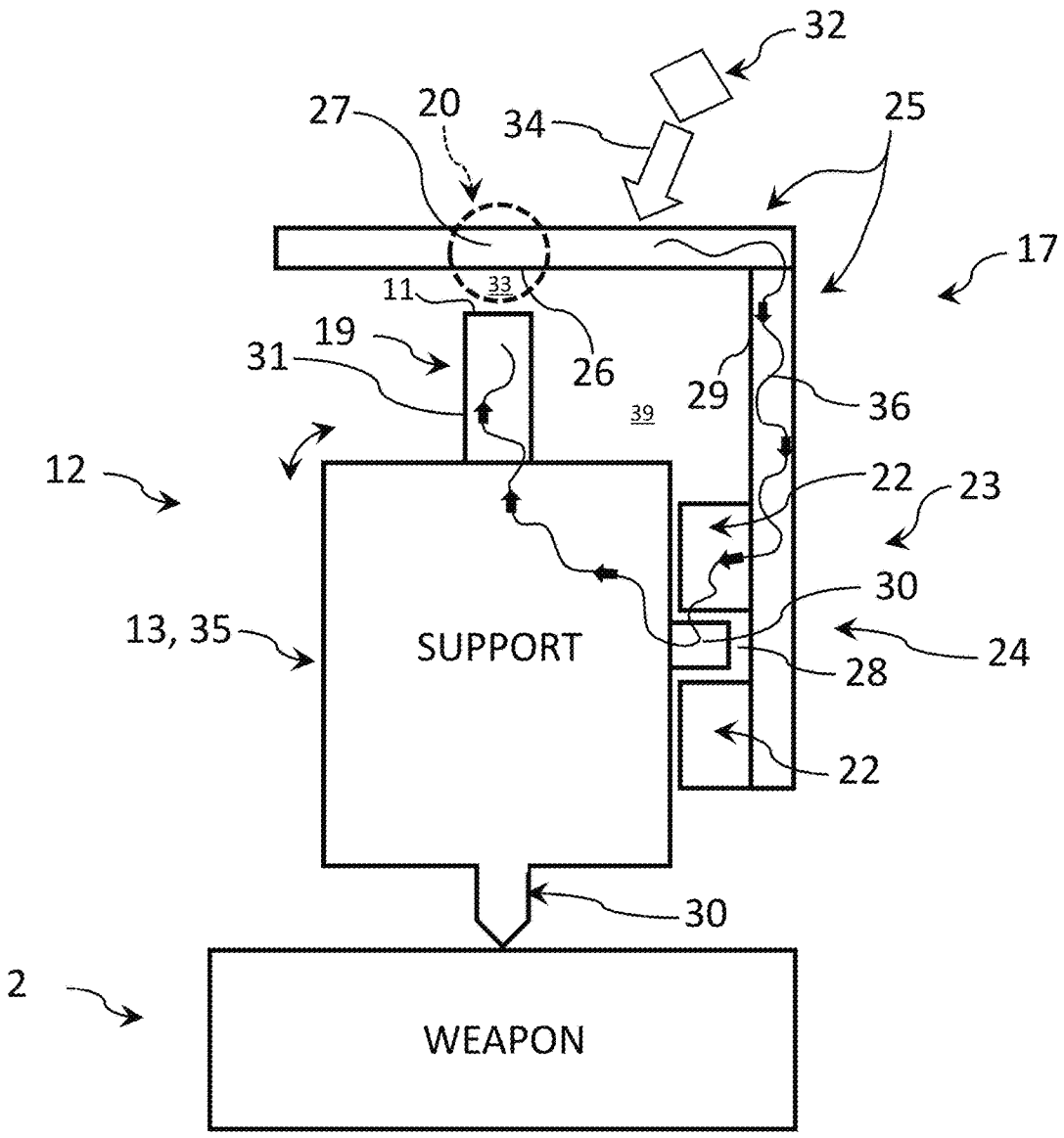
FIG. 4 is a side view of another embodiment of an accessory guard.
Figure 5:
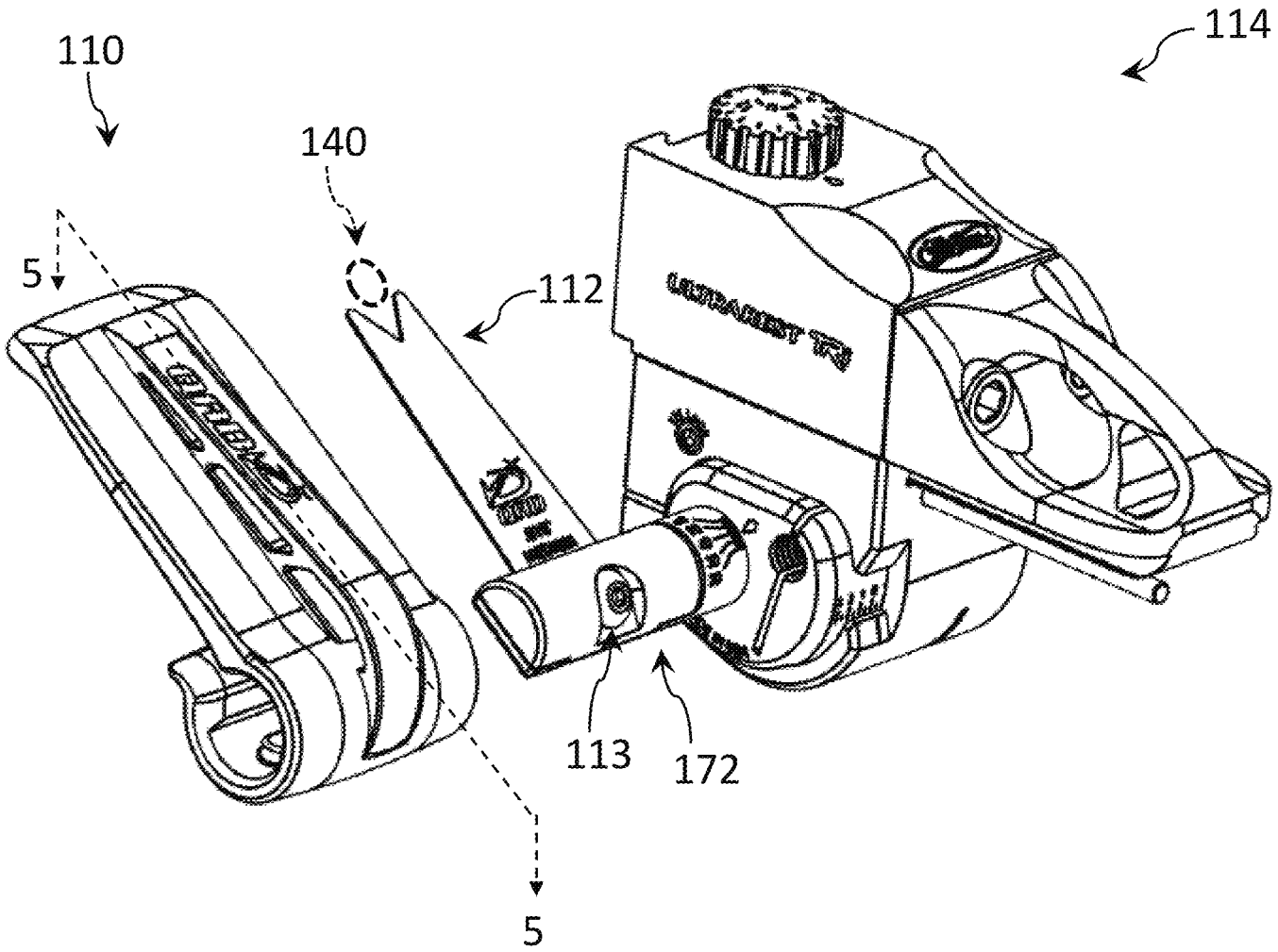
FIG. 5 is an isometric view of an embodiment of an archery accessory assembly, showing the archery accessory guard removed from the support.

Referring to FIG. 4, in an embodiment, an accessory guard 17 is configured to be removably attached to a weaponry accessory 12. Depending on the embodiment, the accessory guard 17 can include a weapon accessory guard, such as an archery accessory guard. The weaponry accessory 12 is connectable to, connected to, or integral with, the weapon 2. In an embodiment, the weaponry accessory 12 has a support 13 and an accessory element 19 coupled to or otherwise supported by the support 13. In the example shown, the support 13 is moveably connected to the weapon 2. In an embodiment, the accessory element 19 includes an archery accessory element. In one condition of the weaponry accessory 12, the support 13 has one position relative to the weapon 2. In another condition of the weaponry accessory 12, the support 13 has another position relative to the weapon 2. For example, the support 13, when coupled to the weapon 2, can be rotatable, pivotal or slidable relative to the weapon 2.

In an embodiment, the accessory guard 17 includes: (a) the securement, connector, mount or coupler 24 having a coupler 22 configured to be removably attached or mounted to the support 13 of the weaponry accessory 12; and (b) the cover, shield, blocker, arm, frame, extension or body 25 connected to the coupler 24. When the coupler 22 is connected or secured to the support 13, the coupler 22 has a securement condition 23 in which the coupler 22 is fixedly secured to the support 13. In an embodiment, the coupler 22 defines a cavity 28 that receives a support portion 30 of the support 13. Depending on the embodiment, the coupler 22 can be predisposed to apply a compression force to the support portion 30. Alternatively, the accessory guard 17 can include a fastener, such as a screw or bolt, that connects or secures the coupler 22 to the support 13. Depending on the embodiment, the coupler 22, coupler 24, and body 25 can be separate components coupled together or portions of a single, unitary object.

In an embodiment, the coupler 22 interlocks or fits with the support portion 30 in a male-female configuration in which the coupler 22 mates with the support portion 30. In this embodiment, the coupler 22 has interference surfaces that, when engaged with the support portion 30, cause an interference that inhibits the coupler 22 from rotating, pivoting or sliding relative to the support portion 30.

Referring to FIGS. 3 and 4, in an embodiment, the body 25 includes body surfaces or guard surfaces 26, 29. The guard surface 26 of the body 25 extends over, covers or blocks part or all of the element part 11. The guard surface 29 extends over, covers or blocks part or all of the element body 31 of the accessory element 8, 19. In an embodiment, both of the guard surfaces 26, 29 are spaced apart from the accessory elements 8, 19 so that the guard surfaces 26, 29 are separated from the accessory elements 8, 19 by gaps 33, 39, respectively. In another embodiment not shown in FIGS. 3-4, only the guard surface 26 is separated from the element part 11 by a gap 33 while the guard surface 29 is in physical contact with part or all of the element body 31.

If an environmental object 32, such as a tree branch, an equipment bag or a person's arm, were to move toward the accessory element 8, 19, the environmental object 32 would eventually collide with the body 25. The environmental object 32 would apply an undesirable force 34 to the body 25. In the embodiment shown in FIG. 3, the body 25 would then transmit the undesirable force 34 to the support 6. In the embodiment shown in FIG. 4, the body 25 would then transmit the undesirable force 34 to the support 13. In this way, the body 25 diverts the undesirable force 34 to the support 6, 13 so that at least the element part 11 of the accessory element 8, 19 is initially isolated from the undesirable force 34. Also, the body 25 prevents or inhibits the environmental object 32 from physically contacting at least the element part 11 of the accessory element 8, 19, which can be delicate or prone to damage.

The element part 11 is, at least initially, isolated from the undesirable force 34 due to the body 25 and support 35. In the embodiment shown in FIG. 4, the support 13 can move relative to the weapon 2 in response to the undesirable force 34. As shown in FIGS. 3-4, the undesirable force 34 is configured to travel or propagate along a force transmission 36. Initially, the force transmission 36 flows through the body 25 avoiding the element part 11. Then, the force transmission 36 flows to the support 35. Depending on the magnitude of the undesirable force 34 and mechanical and physical properties of the body 25, support 35 and weapon 2, the force transmission 36 may or may not travel to the accessory element 8, 19. If part of the force transmission 36 does travel to the accessory element 8, 19, that part could reach the element part 11. As a result of any part of the force transmission 36 reaching the element part 11, the element part 11 could vibrate or otherwise exhibit or output energy, which would not damage the element part 11.

Depending on the embodiment, the accessory guard 4, 17 is compatible with a variety of different types and shapes of weapons 2. In an embodiment, the weapon 2 includes an archery bow operable to launch the weaponry object 20 (such as an arrow or projectile) based, at least in part, on a spring force applied to the weaponry object 20. By way of a non-limiting example, the archery bow can include a compound bow, crossbow, recurve bow or fishing bow. In another embodiment, the weapon 2 includes a rifle, handgun or other type of firearm.

In an embodiment, each of the accessory elements 8, 19 is operable or usable to assist or aid in the control, adjustment, function, ease-of-use, enhancement or performance of any archery activity, archery function or firearm function, including holding arrows or other devices, marking or illuminating a target, retracting a bow string, controlling a position of power cables, aiming, and shooting.

In an embodiment, each of the accessory elements 8, 19 is configured to physically contact and engage a weaponry object 20. Each of the accessory elements 8, 19 can include: (a) a guide surface or holder configured to guide, hold or support the weaponry object 20 while the weaponry object 20 slides along or dynamically interfaces with the accessory element 8, 19; (b) a disk, a wheel, a roller, a pulley or a ball; or (c) any other type of archery-related surface or member or weaponry-related surface or member.

In an embodiment, each of the accessory elements 8, 19 is associated with: (a) an active mode in which the accessory element 8, 19 performs a weaponry or archery function related to a weaponry or archery activity; and (b) an inactive mode corresponding to a non-weaponry or non-archery activity, such as carrying the weapon 2 from one location in a forest to another location in the forest or transporting the weapon 2 in a vehicle. The body 25 has an activity interference member 27. The activity interference member 27 is positioned and configured to interfere with the weaponry or archery activity during the inactive mode. For example, the activity interference member 27 would interfere with the placement of the weaponry object 20 on the accessory element 8, 19. Therefore, the activity interference member 27 would interfere with any attempt to perform a shooting activity during the inactive mode.

Referring to FIGS. 5-10, in an embodiment, the archery accessory guard 110 is configured to be reversibly or removably attached to the support 172 of the archery accessory assembly 114. In the embodiment illustrated, the archery accessory assembly 114 includes: (a) an archery member or mount 109 configured to be clamped onto, bolted to, screwed onto or otherwise connected to, mounted to or coupled to the bow riser 119; and (b) the archery accessory element 112, which can include an arrow launcher, arrow support, arrow holder, or a blade having a plate shape. The archery accessory assembly 114 includes an arrow rest mechanism configured to be coupled to a bow riser 119 of an archery bow 100.

Figure 9:
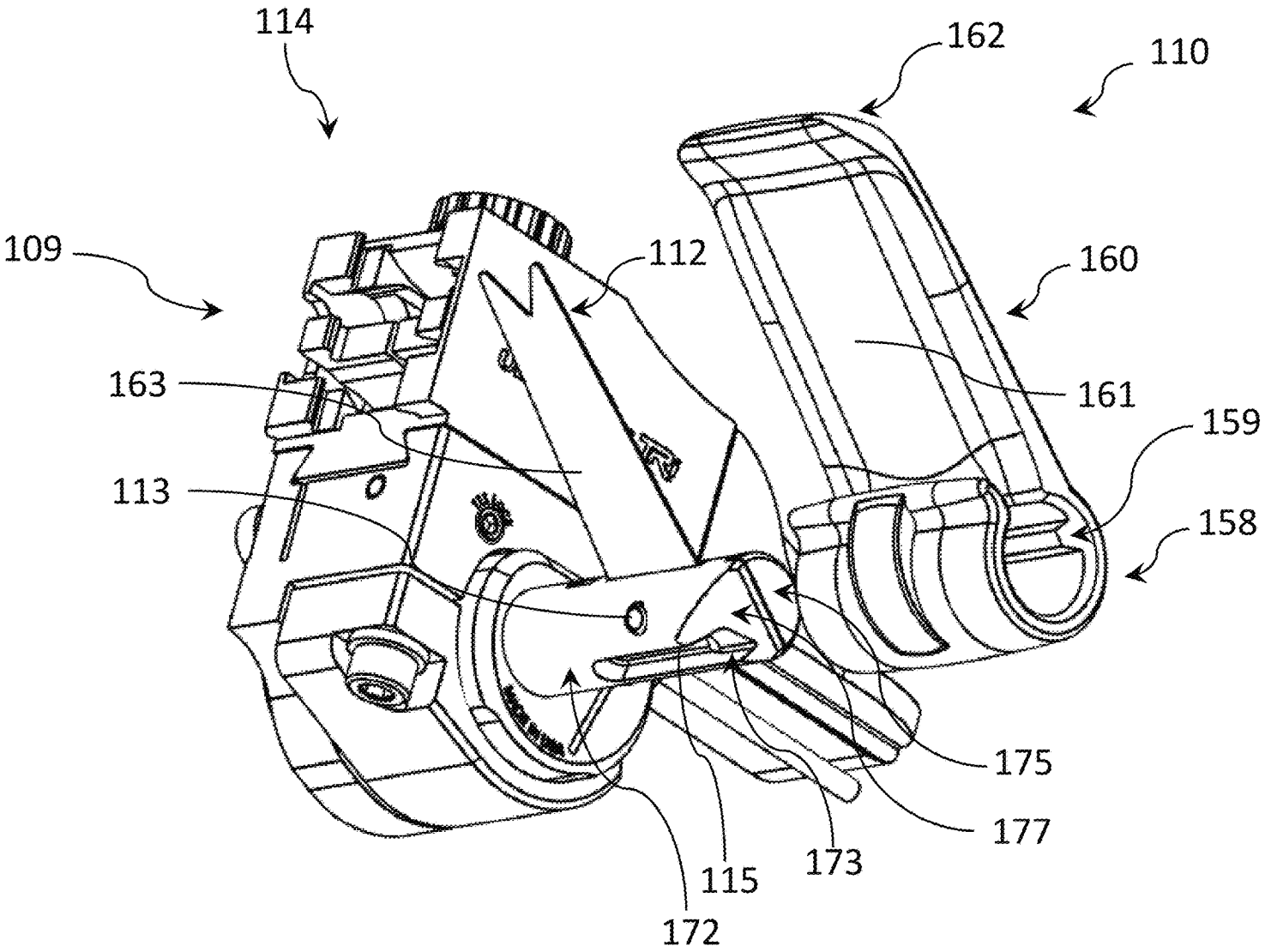
FIG. 9 is a front isometric view of the archery accessory assembly of FIG. 5, showing the archery accessory guard removed from the support.

Depending on the embodiment, the archery accessory element 112 can be disposable or removably attachable to a support member, support portion or support 172 (described below) of the archery accessory assembly 114. For example, as shown in FIG. 9, the archery accessory element 112 is attached or coupled to the support 172 through use of a fastener 113. The fastener 113 can include one or more screws, bolts, pins, clips or other fasteners. Due to the ordinary use of the archery bow 100, the archery accessory element 112 can wear or reach its end of life stage. In that event, the user can replace the worn archery accessory element 112 with a new one by removing and reinstalling the fastener 113.

In the embodiment shown in FIGS. 5-10, the archery bow 100 is a compound bow having: (a) the bow riser 119 configured to at least partially extend along a vertical axis 120, which extends in a vertical plane 121; (b) upper and lower limbs 122, 124 configured to flex relative to the bow riser 119; (c) upper and lower cams or rotors 126, 128 rotatably coupled to the upper and lower limbs 122, 124, respectively; (d) a power cord set 130 that couples the rotors 126, 128 together and is anchored to the limbs 122, 124; (e) a cord management device 132 having a plurality of pulleys, disks or wheels 134 configured engage, and control the position of, the power cord set 130; (f) a bowstring or draw cord 136 coupled to the limbs 122, 124; and (g) a cord stopper 138 coupled to the bow riser 119 to engage, and limit a forward movement of, the draw cord 136. As shown, the bow riser 119 defines or includes a grasp or handle section 117 for grasping by the archer.

The archery accessory assembly 114 is configured to be clamped onto the bow riser 119. When clamped onto the bow riser 119, the archery accessory element 112 is configured to support and guide the arrow or projectile 140. The draw cord 136 is arranged to move in a forward direction 142 to apply a force to the projectile 140, launching the projectile 140 along the shooting axis 144 toward the target 146. When the archer is aiming, the archery accessory element 112 holds the projectile 140 in a fixed position relative to the bow riser 119. As the projectile 140 departs the archery bow 100, the archery accessory element 112 pivots downward to avoid interference with the projectile 140.

In the setup process, depending on the embodiment, the archery accessory assembly 114 can enable the user to adjust a plurality of positions of the archery accessory element 112 relative to the bow riser 119, including: (a) a vertical position that is variable along the vertical axis Y; (b) a lateral position that is variable along the lateral axis X; and (c) a fore-aft position that is variable along the fore-aft axis Z.

Figure 11:
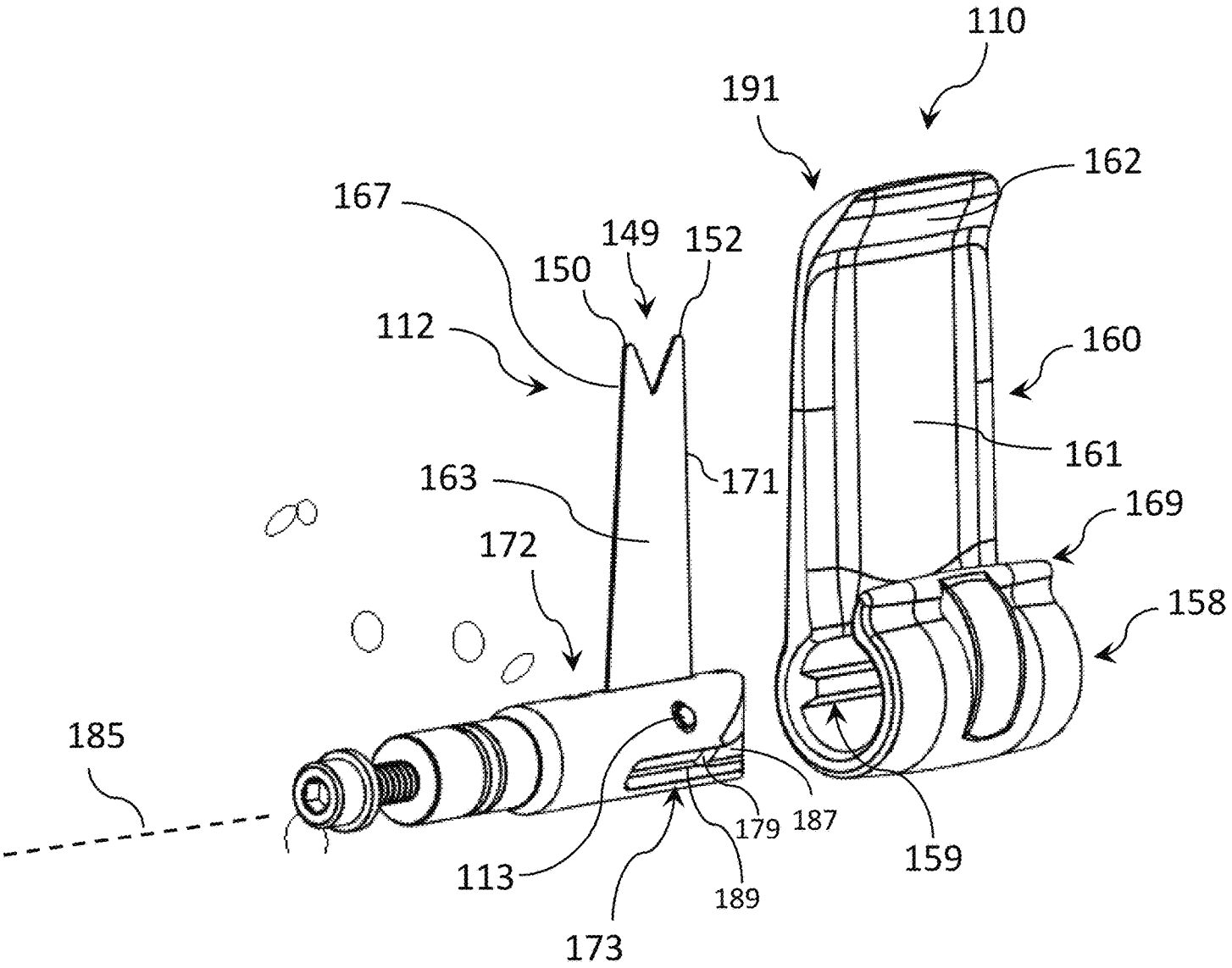
FIG. 11 is a front isometric view of the archery accessory guard and the archery accessory element fastened to the support, showing the archery accessory guard detached from the support.
Figure 12:
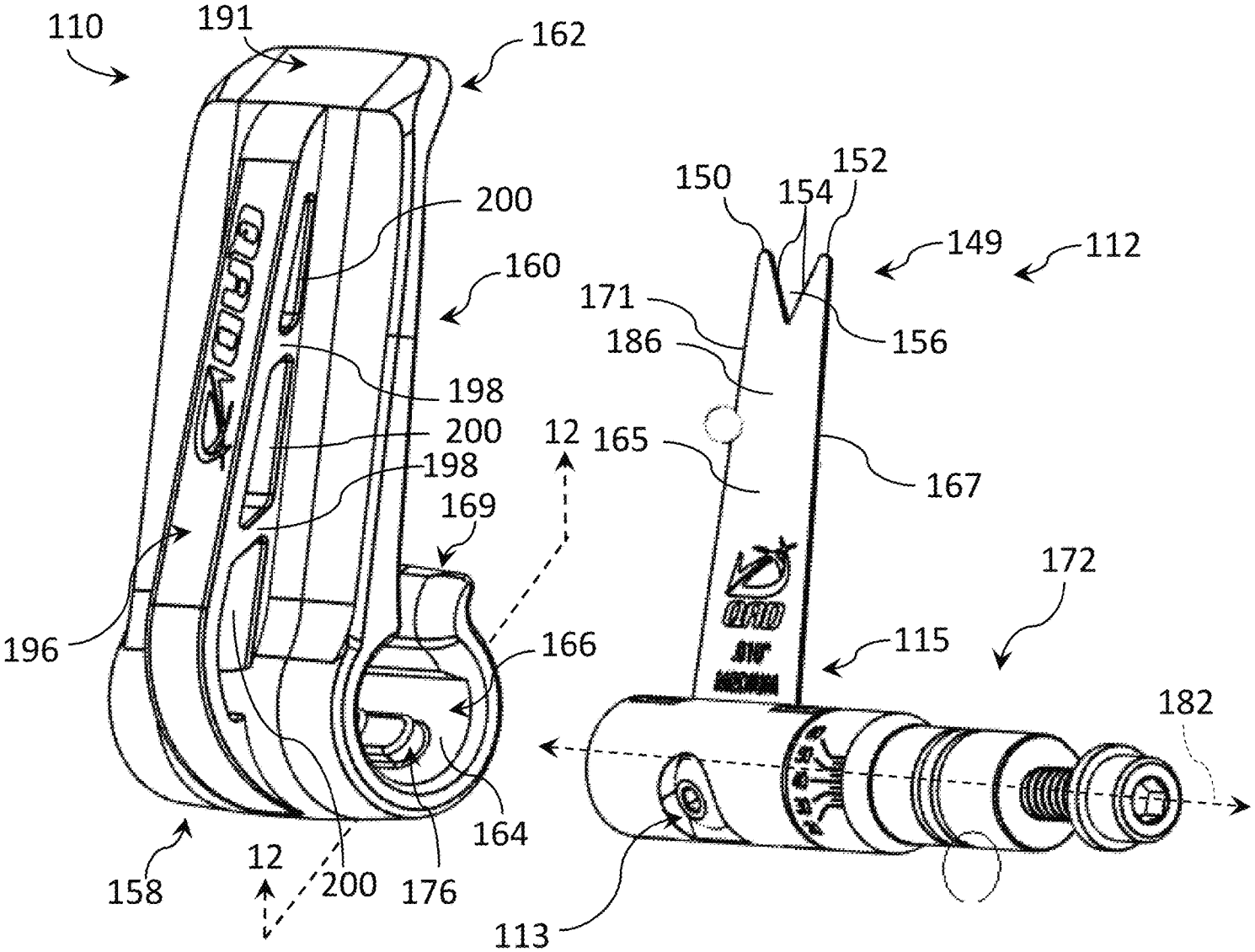
FIG. 12 is a rear isometric view of the archery accessory guard and the archery accessory element fastened to the support, showing the archery accessory guard detached from the support.

Referring to FIGS. 11-12, the archery accessory element 112 has an element part 149 at the top of the archery accessory element 112. The element part 149 has a plurality of peak portions 150, 152 spaced apart by a valley surface 154 defining a valley space 156. Each peak portion 150, 152 has a relatively sharp point that is potentially hazardous. In an embodiment, the archery accessory element 112 is a metallic blade so that the peak portions 150, 152 can pose a hazard or damage risk to people and things that might come into contact with the peak portions 150, 152. For example, when a user is carrying or transporting the archery bow 100, the peak portions 150, 152 might poke, jab, become caught on, or become intertwined with a person's body or clothing, a tree branch, a carrying bag, or the upholstery of a vehicle.

The archery accessory guard 110 at least partially isolates the archery accessory element 112 from the nearby environment when the archery bow 100 is not in use for shooting, whether temporarily set on the ground or floor, temporarily leaned against a tree or wall, or stored, carried or transported. As illustrated in FIGS. 9-15, in an embodiment, the archery accessory guard 110 includes: (a) a coupler 158; and (b) a body 160 connected to, and extending from, the coupler 158. As described below, the body 160 has a plurality of body surfaces or guard surfaces 161, 162. Depending on the embodiment, the coupler 158 and body 160 can be separate components coupled together or portions of a single, unitary object, as in the embodiment shown.

Figure 13A:
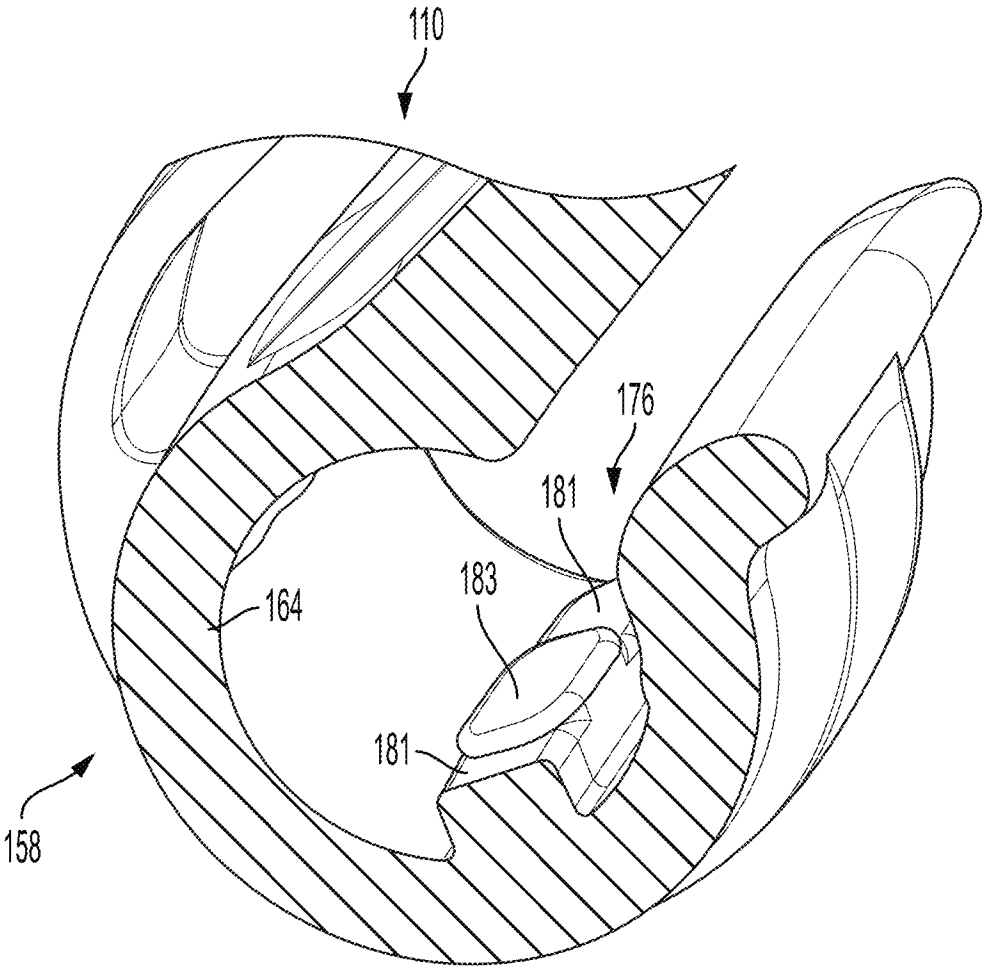
FIG. 13A is a cross-sectional view of the coupler of the archery accessory guard, taken substantially along lines 12-12 of FIG. 12.
Figures 13B, 13C:
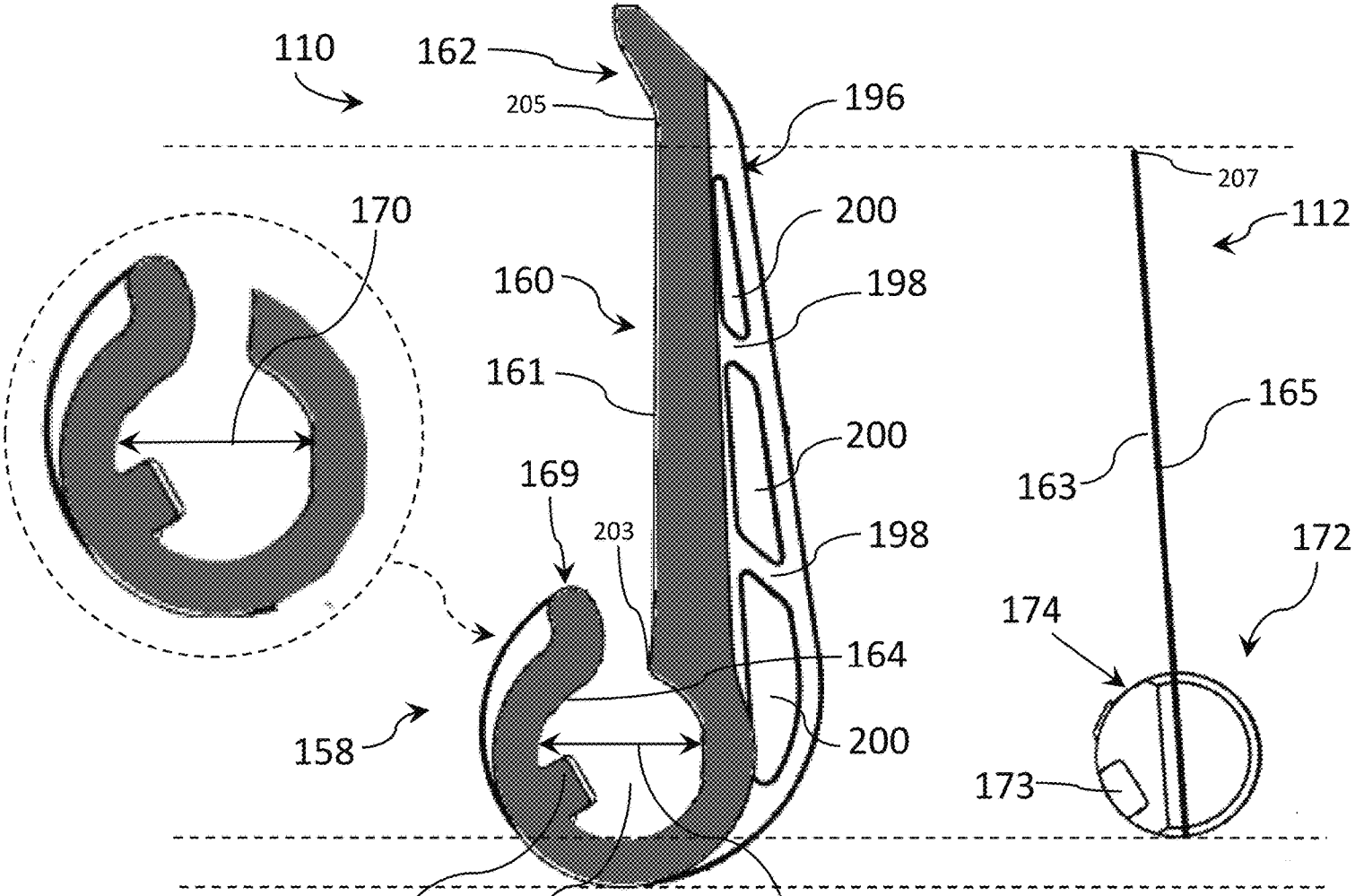
FIG. 13B is a cross-sectional view of the archery accessory guard, taken substantially along lines 5-5 of FIG. 5.
FIG. 13C is a side elevation view of the archery accessory element.

Referring to FIGS. 13A-13C, the coupler 158 has an inner surface 164 that defines a cavity 166. In the embodiment shown, the cavity 166 includes a passageway or channel having a cylindrical shape. In an embodiment, the coupler 158 has an elastic characteristic. Because of the elastic characteristic, the user can increase the size of the cavity 166 from a predisposed diameter 168 to an increased diameter 170.

Figure 10:
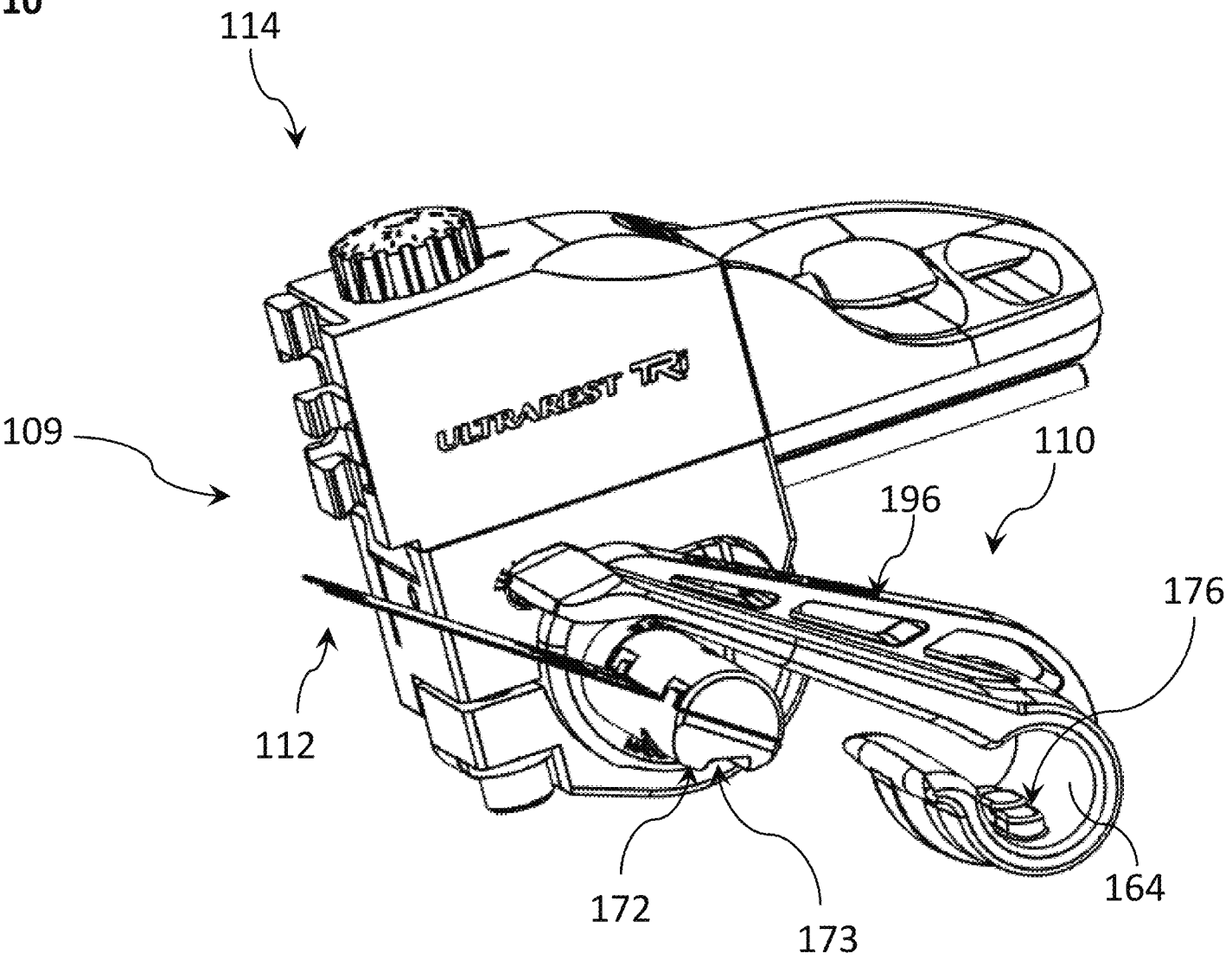
FIG. 10 is a side isometric view of the archery accessory assembly of FIG. 5, showing the archery accessory guard removed from the support.

For example, the user can slide the coupler 158 onto and over the support 172 of the archery accessory assembly 114 according to a snap fit configuration. Depending on the embodiment, the support 172 can include a cylindrical member (as illustrated) or a shaft, tube, rod, arm or extension of any suitable geometry. As shown in FIG. 10, the support 172 defines a cavity or slot 173. The slot 173 is sized and shaped to receive the rotation inhibitor 176, shown in FIG. 12 and described below.

In an embodiment, as illustrated in FIG. 9, the support 172 has upper and lower parts 175, 177, and the lower part 177 defines the slot 173. In such embodiment, the user can place the archery accessory element 112 between the parts 175, 177 and then insert the element bottom 115 of the archery accessory element 112 into the slot 173. Next, the user can rotate and screw the fastener 113 to secure the archery accessory element 112 to the support 172. In another embodiment, the support 172 is a one-piece, unitary structure that defines the slot 173. In such embodiment, the user can insert the archery accessory element 112 through the slot 173 and then rotate the fastener 113 to secure the archery accessory element 112 to the support 172.

In an embodiment, as illustrated in FIG. 11, the support 172 has a ramp 179 positioned within the slot 173. The ramp 179 includes a protrusion, irregularity, lock or securement member. As described below, the ramp 179 engages with the archery accessory guard 110 so as to prevent or inhibit the support 172 from unintentionally becoming decoupled from the archery accessory guard 110.

In addition, the support 172 has an exterior diameter 174, shown in FIG. 13C, that is greater than the predisposed diameter 168. Therefore, when the support 172 enters the cavity 166, the support 172 enlarges and expands the cavity 166 to the increased diameter 170. When the cavity 166 has the increased diameter 170, the coupler 158 applies a compression force to the support 172. This compression force contributes to the securement of the archery accessory guard 110 onto the support 172. In other words, the archery accessory guard 110 is attachable to the support 172 through a snap fit or press fit arrangement.

In an embodiment, the upper end 169 of the coupler 158 includes a spring or a spring characteristic. When the archery accessory guard 110 is attached to the support 172, the upper end 169 applies a biasing or spring force that acts radially inward toward the support 172. Also, the upper end 169 is configured to aid in retaining the support 172 in a fixed location relative to the coupler 158.

In addition, the coupler 158 has a rotation inhibitor 176 sized, shaped and configured to fit into, and mate with, a positioning groove, cavity or slot of the support 172. In the illustrated embodiment, the rotation inhibitor 176 is sized, shaped and configured to fit into, and mate with, the slot 173 of the support 172. In an embodiment, the rotation inhibitor 176 includes a male mating member, protrusion, keyway or notch that fits into the slot 173, a compatible female cavity. In operation, the user aligns the rotation inhibitor 176 with the slot 173 and then slides the archery accessory guard 110 onto the support 172, which causes the rotation inhibitor 176 to slide into the slot 173.

Referring back to FIGS. 10-11 and 13A, in an embodiment, the rotation inhibitor 176 has an irregular or stepped configuration including a lower surface 181 and an upper engagement surface 183. When the user slides the archery accessory guard 110 onto the support 172, the lower surface 181 slides along axis 185 and passes the ramp 179. As the sliding continues, the upper engagement surface 183 reaches and engages with the ramp 179. To secure the archery accessory guard 110 onto the support 172, the user applies a sliding force that overcomes the interference between the ramp 179 and the upper engagement surface 183. In this process, the coupler 158 of the archery accessory guard 110 slightly flexes and expands to enable the upper engagement surface 183 to slide from the unsecure axial position 187 to the secure axial position 189, as illustrated in FIG. 11. Once the upper engagement surface 183 is located in the secure axial position 189, the archery accessory guard 110 is axially secured to the support 172. If a user force or other force were to undesirably or unintentionally pull the archery accessory guard 110 along the axis 185, the upper engagement surface 183 would contact and interfere with the ramp 179 to prevent or inhibit the undesirable decoupling of the archery accessory guard 110 from the support 172. In this embodiment, the rotation inhibitor 176 serves dual roles of: (a) inhibiting undesirable rotation of the archery accessory guard 110 relative to the support 172; and (b) inhibiting undesirable translation, axial movement or sliding of the archery accessory guard 110 relative to the support 172.

As illustrated in FIG. 13B, in an embodiment, the body 160 of the archery accessory guard 110 has a strengthener or stiffener 196. The stiffener 196 includes a truss structure having a plurality of bridges 198 defining a plurality of weight-reduction cavities 200. The stiffener 196 increases the rigidity of the body 160 without substantially adding weight to the body 160.

Figure 14:
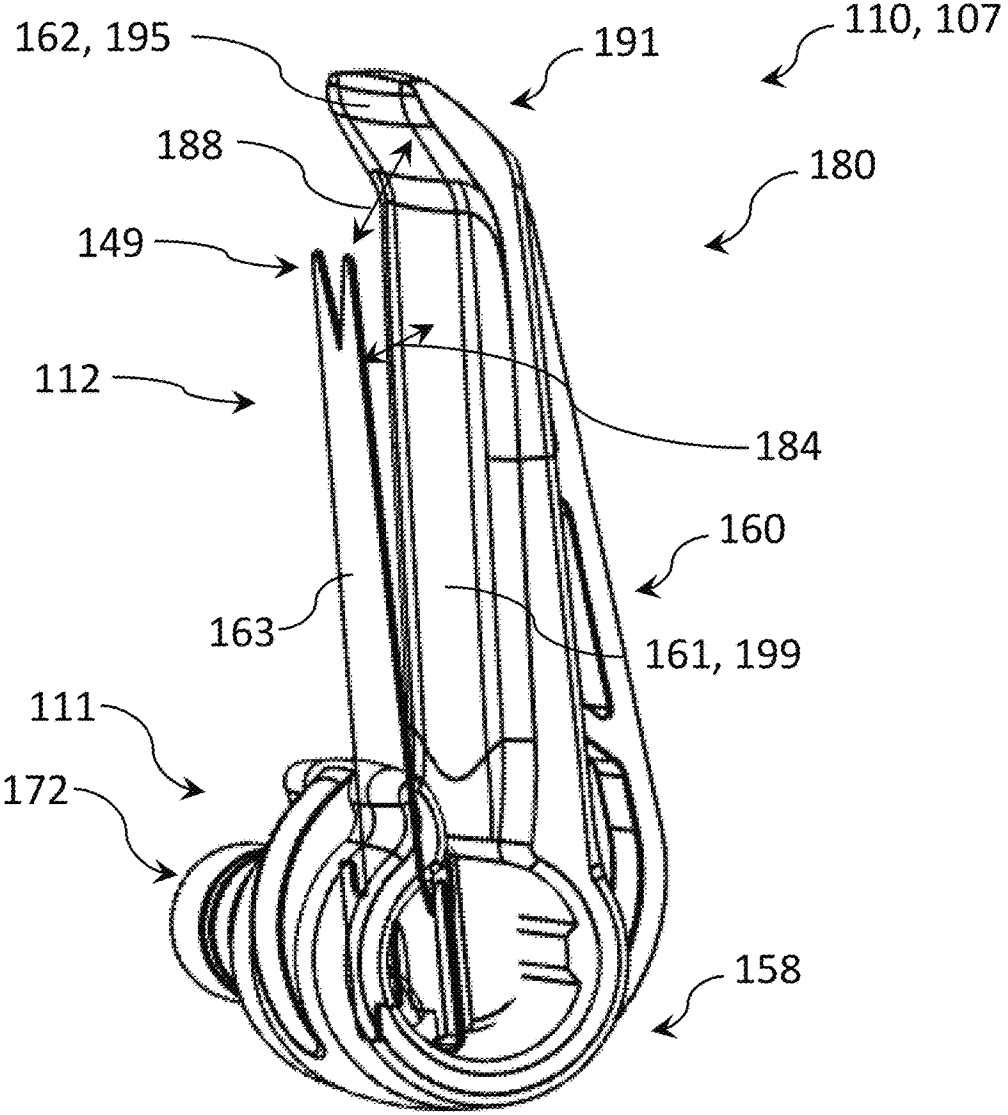
FIG. 14 is an isometric view of the archery accessory guard in the installed position on the support.
Figure 15:
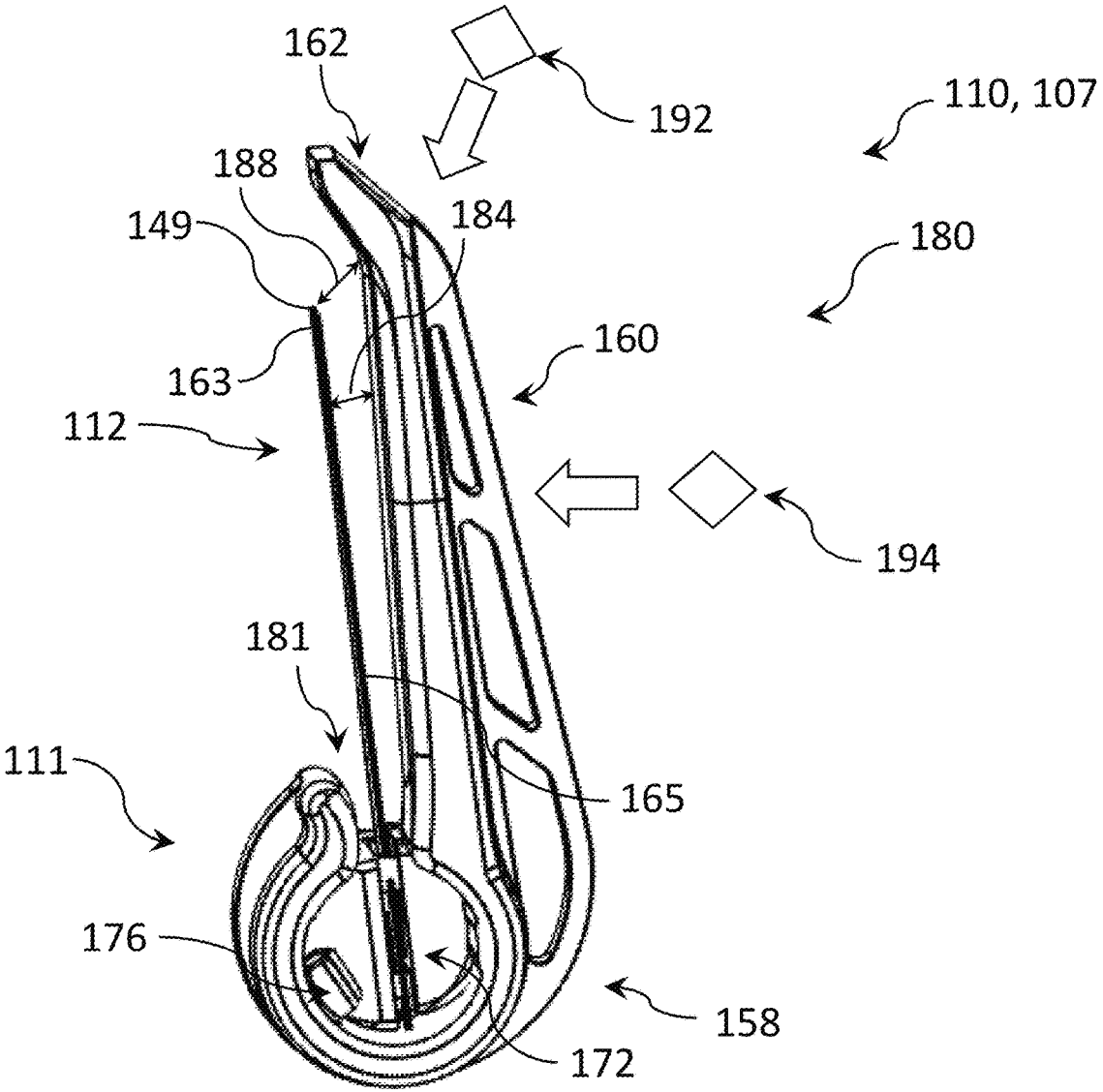
FIG. 15 is a side isometric view of the archery accessory guard in the installed position on the support, illustrating the gaps between the archery accessory guard and the archery accessory element.
Figure 16:
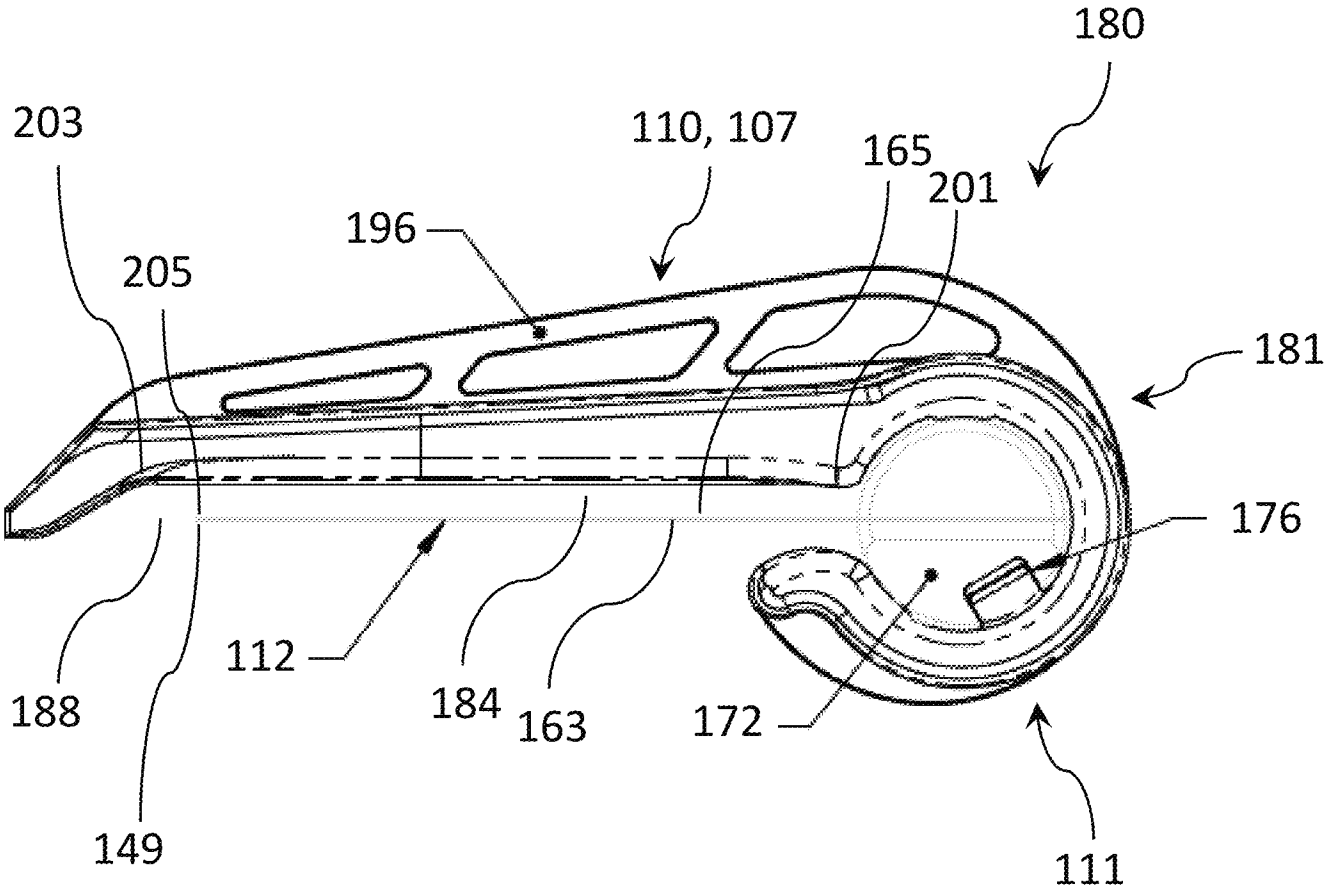
FIG. 16 is a side view of the archery accessory guard in the installed position on the support.

As shown in FIGS. 14-16, when the archery accessory guard 110 has an installed position 107 on the support 172, the rotation inhibitor 176 prevents or inhibits the archery accessory guard 110 from rotating or changing an angular position relative to the support 172. Accordingly, the rotation inhibitor 176 provides the archery accessory guard 110 with a securement condition 111. In the securement condition 111, at least the angular position of the archery accessory guard 110 relative to the support 172 is constant, fixed or set regardless of the forces from the environmental objects 192, 194.

It should be appreciated that, depending on the embodiment, the coupler 158 can have multiple movement inhibitors, including rotation inhibitor 176. Likewise, the support 172 can have multiple positioning slots, including slot 173. For example, the coupler 158 can have a translation inhibitor (not shown) in addition to the rotation inhibitor 176. Such translation inhibitor can prevent or inhibit the movement of the coupler 158, relative to the support 172, along the longitudinal axis 182, shown in FIG. 9, of the support 172.

Referring to FIG. 11, in an embodiment, the coupler 158 has a securement portion 159. The securement portion 159 includes a protrusion or notch that is configured to engage the support 172. By engaging the support 172, the securement portion 159 applies a force that increases or enhances the securement of the coupler 158 to the support 172.

Referring to FIGS. 9, 11 and 13B, in an embodiment, the body 160 includes a guard surface 161. The guard surface 161 is coupled to, connected to, a part of or otherwise extends from the coupler 158. The guard surface 161 is configured to at least partially guard the archery accessory element 112. In this embodiment, the archery accessory element 112 has: (a) an element front face or element front surface 163, as shown in FIGS. 9, 11, 13C, 15, 16 and 17; (b) an element rear face or element rear surface 165, as shown in FIGS. 13C, 15, 16 and 17; and (c) a plurality of edges, sides, side surfaces or sides 167, 171, as shown in FIGS. 11 and 12. The guard surface 161 is configured to at least partially face the element front surface 163 or the element rear surface 165. In the embodiment shown, the guard surface 161 at least partially faces the element rear surface 165.

As shown in FIG. 14, the guard surface 161 extends upward along the upwardly extending element rear surface 165. Depending on the embodiment, the guard surface 161 may or may not extend along a plane that is parallel to the element rear surface 165. In the embodiment shown in FIGS. 13B, 13C and 16, the guard surface 161 extends from a first location 203 to a second location 205. The second location 205 is positioned beyond the end 207 of the archery accessory element 112. Therefore, when the coupler 158 and the archery accessory element 112 are each coupled to the support 172, the body 160 is configured to: (a) at least partially obstruct access to the archery accessory element 112; (b) receive a force from an object 192 directed toward the archery accessory element 12, as shown in FIG. 15; and (c) transmit the force to the support 172.

In an embodiment not shown, the archery accessory guard 110 excludes the guard surface 162. In such embodiment, the guard surface 161 and the upper, distal end portion of the body 160 are straight without a slanted, curved or non-uniform end portion. The fact that the guard surface 161 extends beyond the end 207 of the archery accessory element 112 enables the distal end of the guard surface 161, positioned at second location 205, to interact with any object that might undesirably contact the archery accessory element 12 or the element part 149.

In an embodiment, referring to FIG. 19, the guard surface 161 at least partially faces the element rear surface 165, and the guard surface 213 of the supplemental body 212 (described below) at least partially faces the element front surface 163. In such embodiment, the upper, distal ends of the guard surfaces 161, 213 extend (and are positioned) beyond the end 207 of the archery accessory element 112. In an embodiment, the guard surfaces 161, 213 are configured to guard and protect the end 207 with or without the guard surfaces 162, 214.

Referring back to FIGS. 14-16, when the archery accessory guard 110 has the installed position 107, the archery accessory guard 110 is spaced apart from, and free of contact with, at least the element part 149 of the archery accessory element 112. In the embodiment shown, there is a lateral environmental gap 184 between the element rear surface 165 (FIG. 13C) of the archery accessory element 112 and the guard surface 161. There is also an upper environmental gap 188 between the element part 149 of the archery accessory element 112 and the guard surface 162. Each of the environmental gaps 184, 188 is accessible by the environment, the space and air within which the bow 100 is located. In other words, in this embodiment, the environmental gaps 184, 188 are not enclosed, interior pockets of the archery accessory guard 110.

Referring to FIG. 15, in the installed position 107, the archery accessory assembly 114 is in the inactive mode, in which case the archery accessory assembly 114 (mounted to the bow 100) is being carried stored, or transported carry, store and transport along with the bow 100. In the inactive mode, the lateral environmental gap 184 and the upper environmental gap 188 safeguard the archery accessory element 112 from coming into any damaging contact with the archery accessory guard 110. In one example, a user carries the archery bow 100 outdoors, passing an environmental object 192, such as a tree branch. The archery accessory element 112 moves toward the environmental object 192. Before hitting or contacting the archery accessory element 112, the environmental object 192 hits the body 160 of the archery accessory guard 110. The force from the environmental object 192 transmits to the body 160, which transmits the force to the coupler 158, which transmits the force to the support 172, which transmits the force to the archery bow 100. Despite this force, the lateral environmental gap 184 and the upper environmental gap 188 are maintained. Also, despite this force, the archery accessory guard 110 does not rotate relative to the support 172. This is due to the rotation inhibitor 176 and the compression force of the coupler 158 acting on the support 172.

In another example, an environmental object 194, such as a person's arm, moves downward toward the environmental object 192. Before hitting or contacting the element rear surface 165 of the archery accessory element 112, the environmental object 194 hits the body 160 of the archery accessory guard 110. The force from the environmental object 194 transmits through the body 160 to the coupler 158, which transmits the force to the support 172, which transmits the force to the archery bow 100. Despite this force, the lateral gap 184 and upper environmental gap 188 are maintained. Also, despite this force, the archery accessory guard 110 does not rotate relative to the support 172. This is due to the rotation inhibitor 176 and the compression force of the coupler acting on the support 172.

Figure 6:
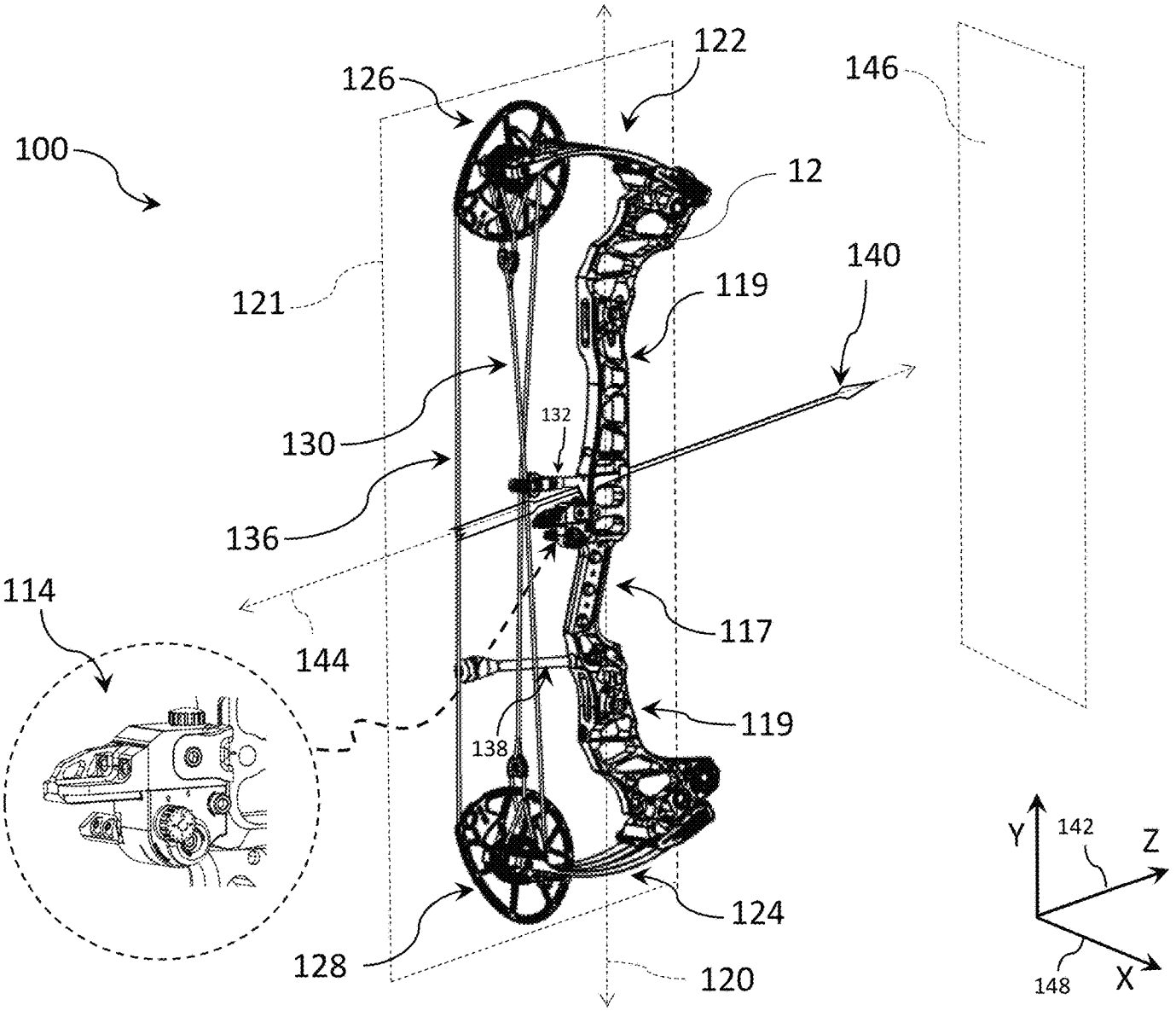
FIG. 6 is an isometric view of an embodiment of an archery bow having the archery accessory assembly of FIG. 5 attached to the archery bow.
Figure 7:
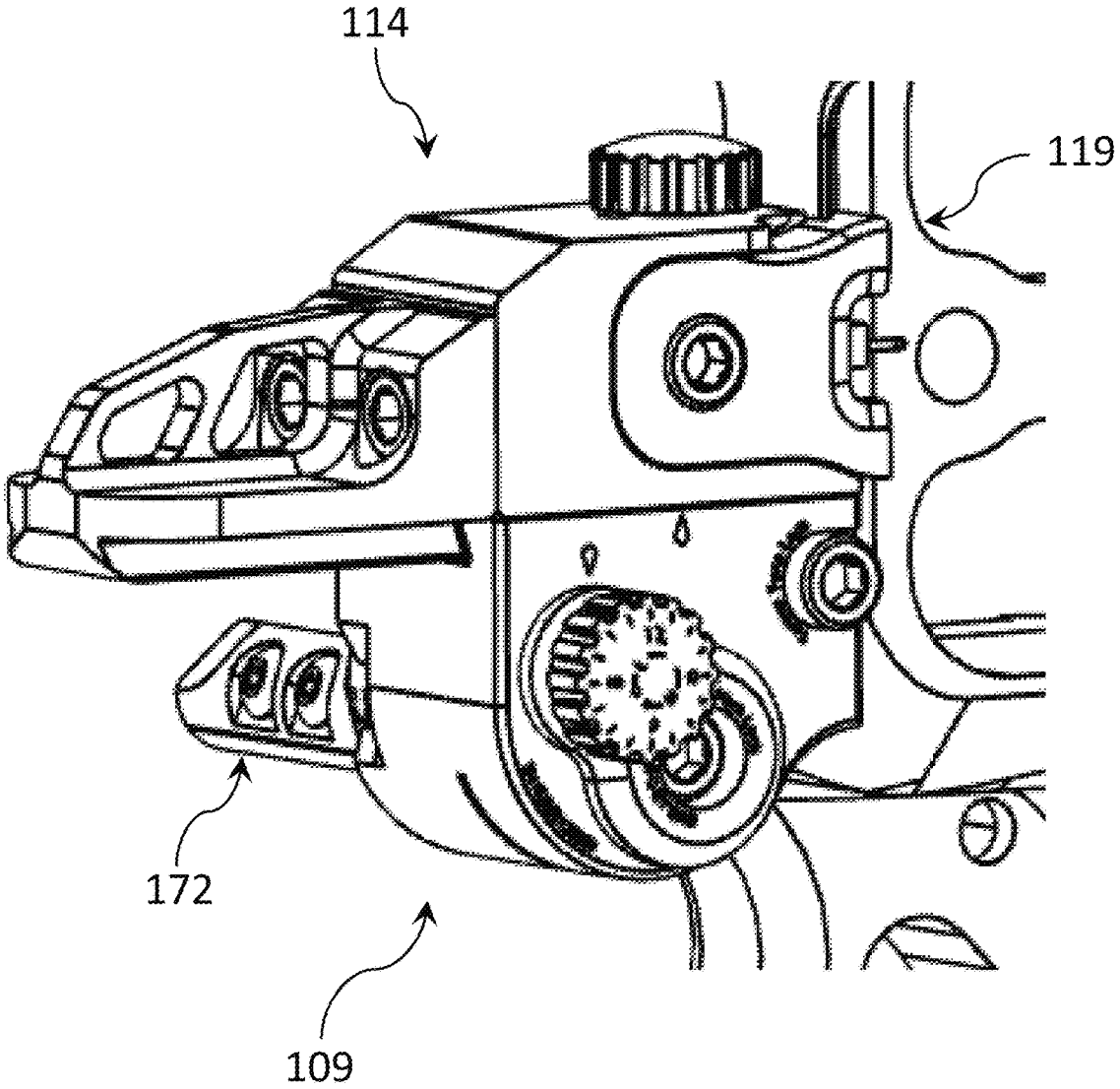
FIG. 7 is a rear isometric view of the archery accessory assembly of FIG. 5 attached to the archery bow.
Figure 8:
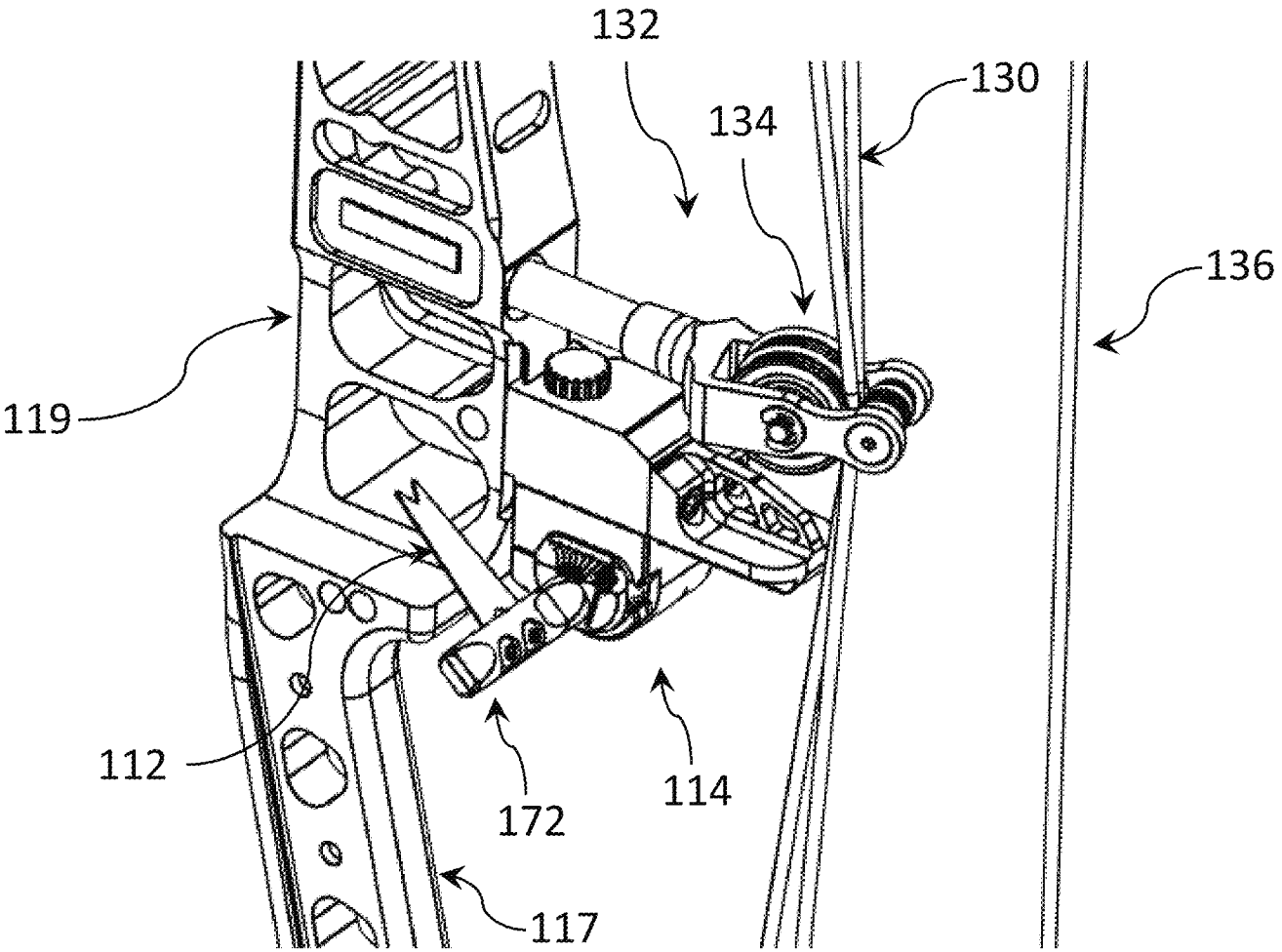
FIG. 8 is a top isometric view of the archery accessory assembly of FIG. 5 attached to the archery bow.

In an embodiment, the archery accessory element 112 is associated with: (a) an active mode in which the archery accessory element 112 performs an archery function related to an archery activity; and (b) an inactive mode corresponding to a non-archery activity, such as carrying the bow 100 from one location in a forest to another location in the forest or transporting the bow 100 in a vehicle. As shown in FIG. 14, the upper body portion 191 of the body 160 has an activity interference member 195, and the body 160 has an activity interference member 199. Each of the activity interference members 195, 199 is positioned and configured to interfere with the archery activity during the inactive mode. For example, the activity interference member 195 would block and interfere with the flight of fletching (not shown) of the projectile 140 (FIG. 6). Likewise, the activity interference member 199 would block and interfere with the flight of the projectile 140. Therefore, the activity interference members 195, 199 would interfere with any attempt to perform a shooting activity during an inactive mode, such as transporting of the bow 100.

Figure 17:
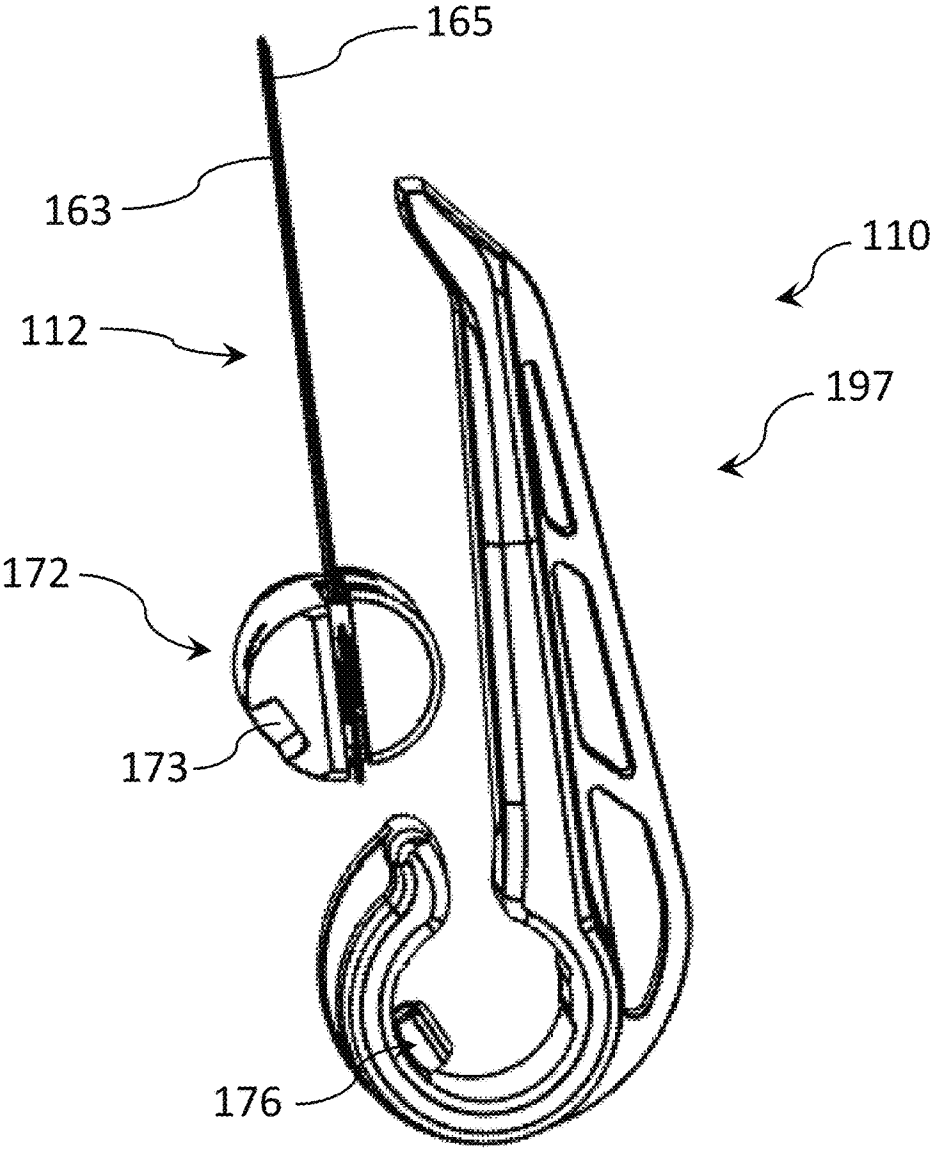
FIG. 17 is a side isometric view of the archery accessory guard in the uninstalled position relative to the support and the archery accessory element.
Figure 18:
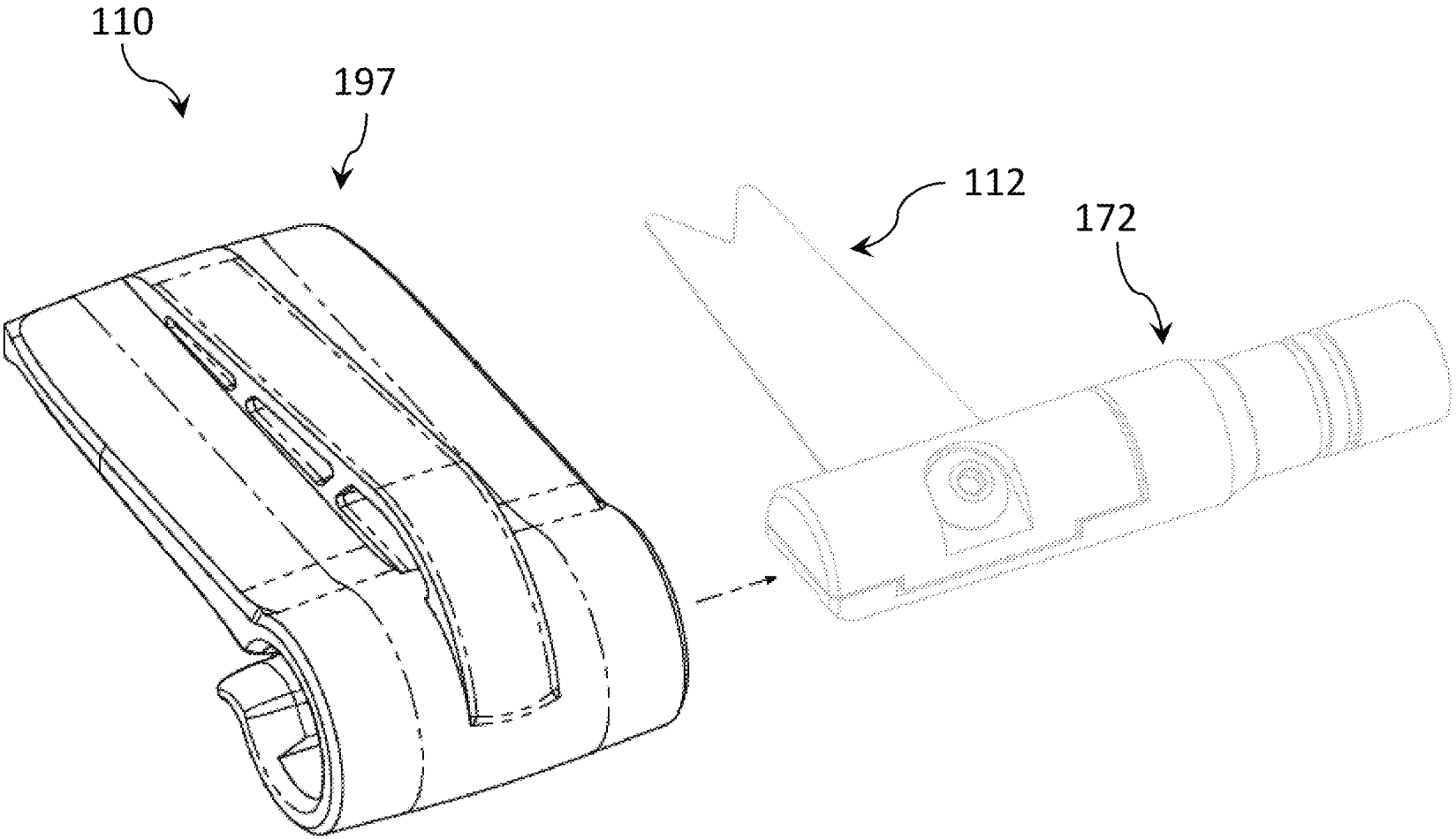
FIG. 18 is a top isometric view of the archery accessory guard in the uninstalled position relative to the support and the archery accessory element.

To remove or uninstall the archery accessory guard 110, the user can manually apply a threshold removal force to eventually slide the archery accessory guard 110 until the archery accessory guard 110 snaps off of the support 172. This causes the archery accessory guard 110 to have an uninstalled position 197, as shown in FIGS. 17-18. In the uninstalled position 197, the user can use the archery accessory assembly 114 in the active mode, such as aiming and shooting.

Figure 19:
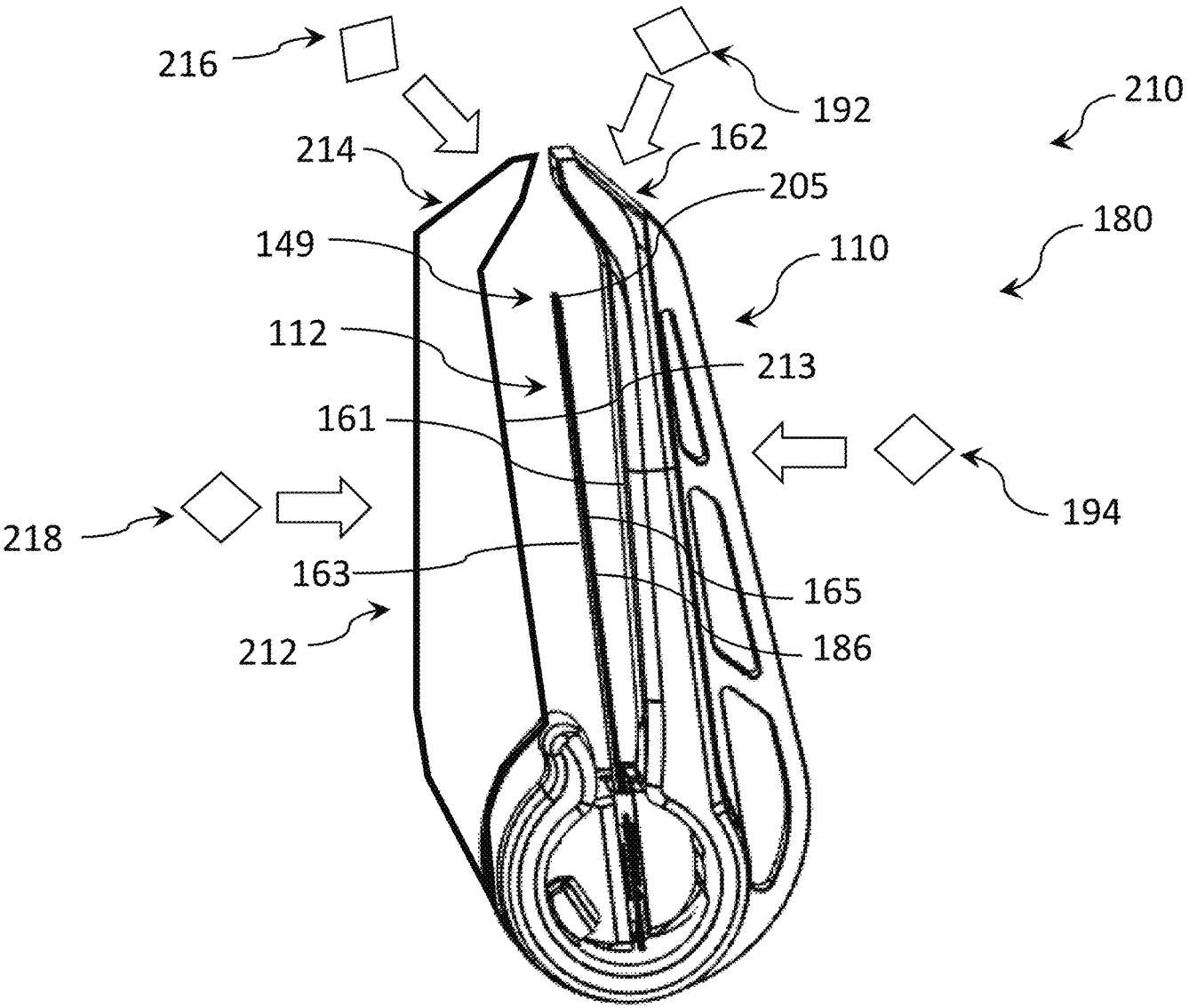
FIG. 19 is a side isometric view of an embodiment of an archery accessory guard that has a plurality of bodies at least partially surrounding the archery accessory element.

In another embodiment shown in FIG. 19, the archery accessory guard 210 has the same structure, elements, characteristics and functionality as the archery accessory guard 110 except the archery accessory guard 210 has a supplemental body 212. The supplemental body 212 has the same structure, elements, characteristics and functionality as the body 160 except the supplemental body 212 is oriented as the mirror image of the body 160. As shown, the archery accessory guard 210 surrounds the element front and rear surfaces 163, 165 of the archery accessory element 112. Also, the archery accessory guard 210 covers all or most of the element part 149 of the archery accessory element 112. Accordingly, the archery accessory guard 210 protects and isolates the archery accessory element 112 from contact with, and forces by, environmental objects, including the environmental object 192, environmental object 194, environmental object 218, and environmental object 216.

Figure 20:
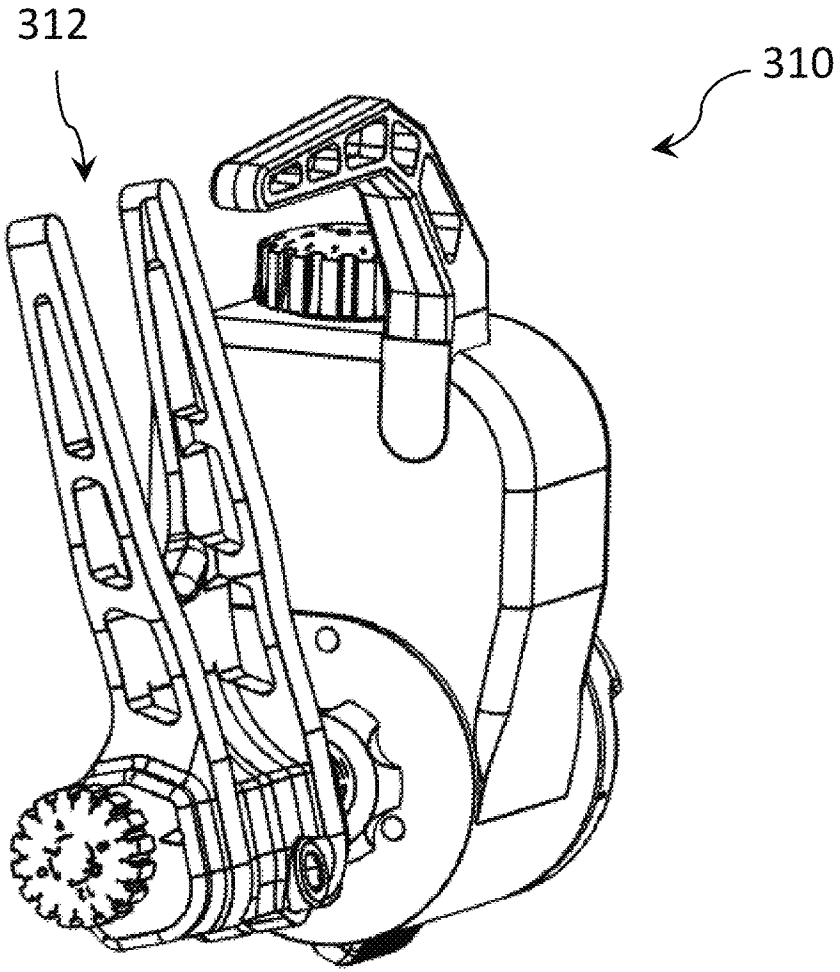
FIG. 20 is an isometric view of an arrow rest assembly for which an embodiment of the archery accessory guard is configured to at least partially surround and guard.
Figure 21:
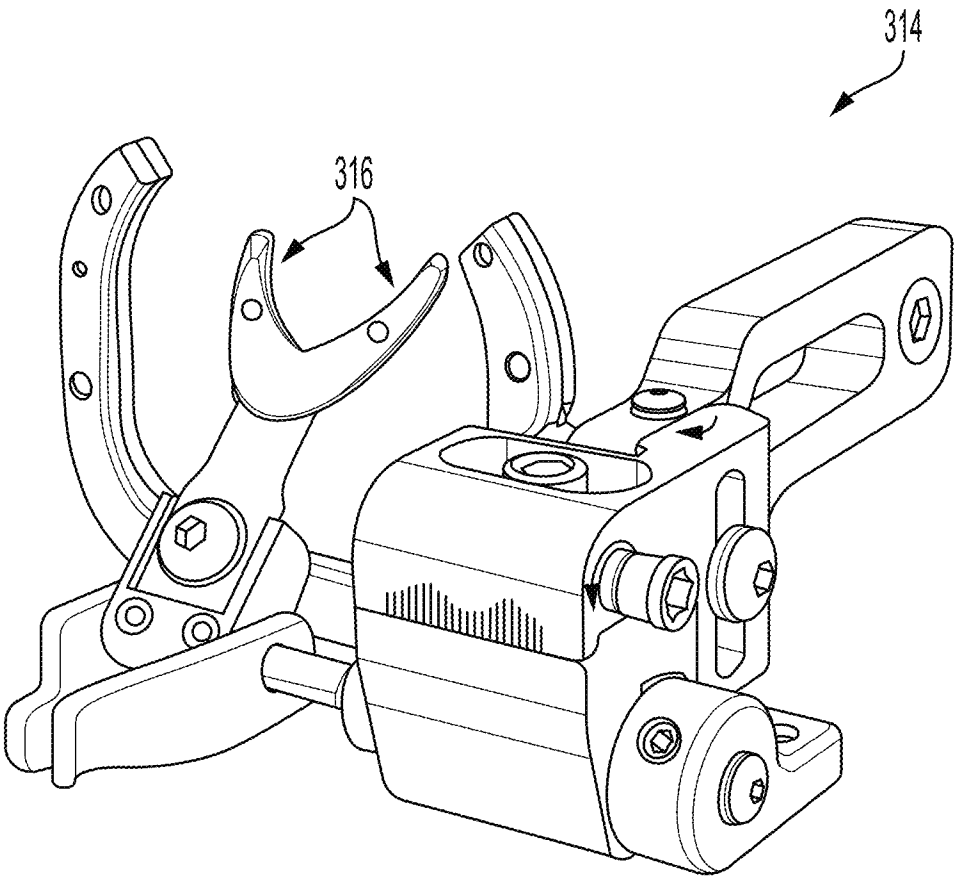
FIG. 21 is an isometric view of another arrow rest assembly for which an embodiment of the archery accessory guard is configured to at least partially surround and guard.
Figure 22:
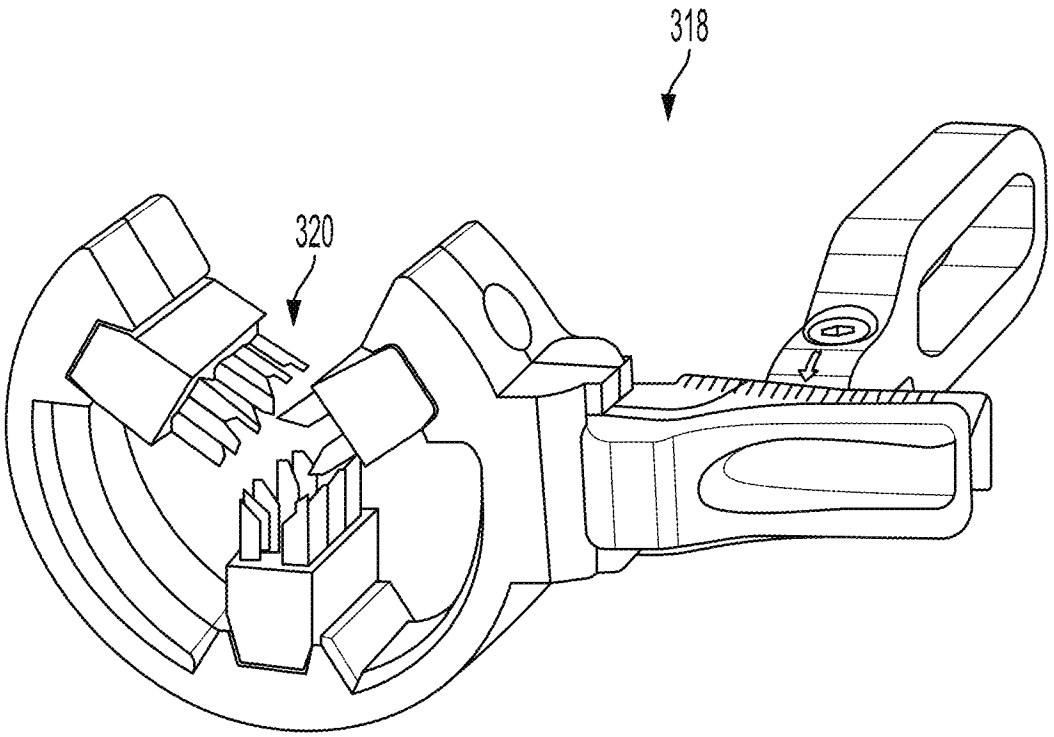
FIG. 22 is an isometric view of yet another arrow rest assembly for which an embodiment of the archery accessory guard is configured to at least partially surround and guard.
Figure 23:
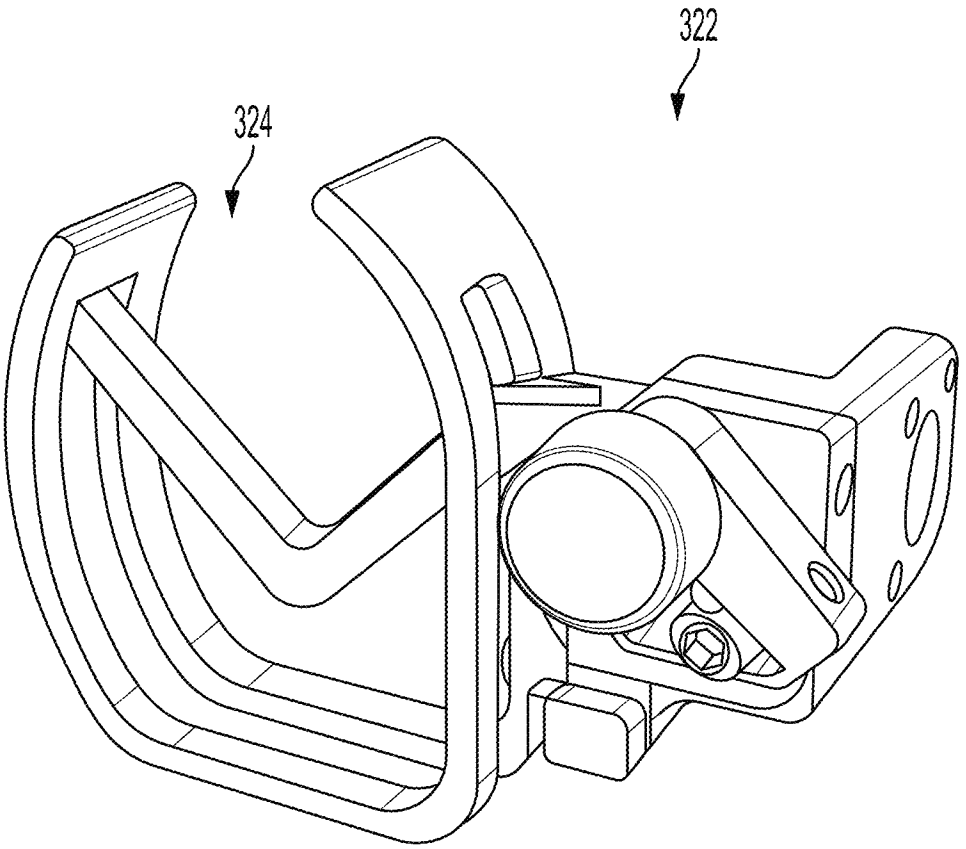
FIG. 23 is an isometric view of still another arrow rest assembly for which an embodiment of the archery accessory guard is configured to at least partially surround and guard.

It should be understood that each of the archery accessory guards 4, 17, 110, 210 is configured to be removably attached to a variety of different types of arrow rest assemblies, including: (a) the archery accessory assembly 114, shown in FIG. 5, which has the archery accessory element 112 protectable by either of the archery accessory guards 4, 17, 110, 210; (b) the arrow rest assembly 310, shown in FIG. 20, which has the archery accessory element 312 protectable by either of the archery accessory guards 4, 17, 110, 210; (c) the arrow rest assembly 314, shown in FIG. 21, which has archery accessory element 316 protectable by either of the archery accessory guards 4, 17, 110, 210; (d) the arrow rest assembly 318, shown in FIG. 22, which has archery accessory element 320 (bristles) protectable by either of the archery accessory guards 4, 17, 110, 210; and (e) the arrow rest assembly 322, shown in FIG. 23, which has archery accessory element 324 protectable by either of the archery accessory guards 4, 17, 110, 210.

Figure 24:
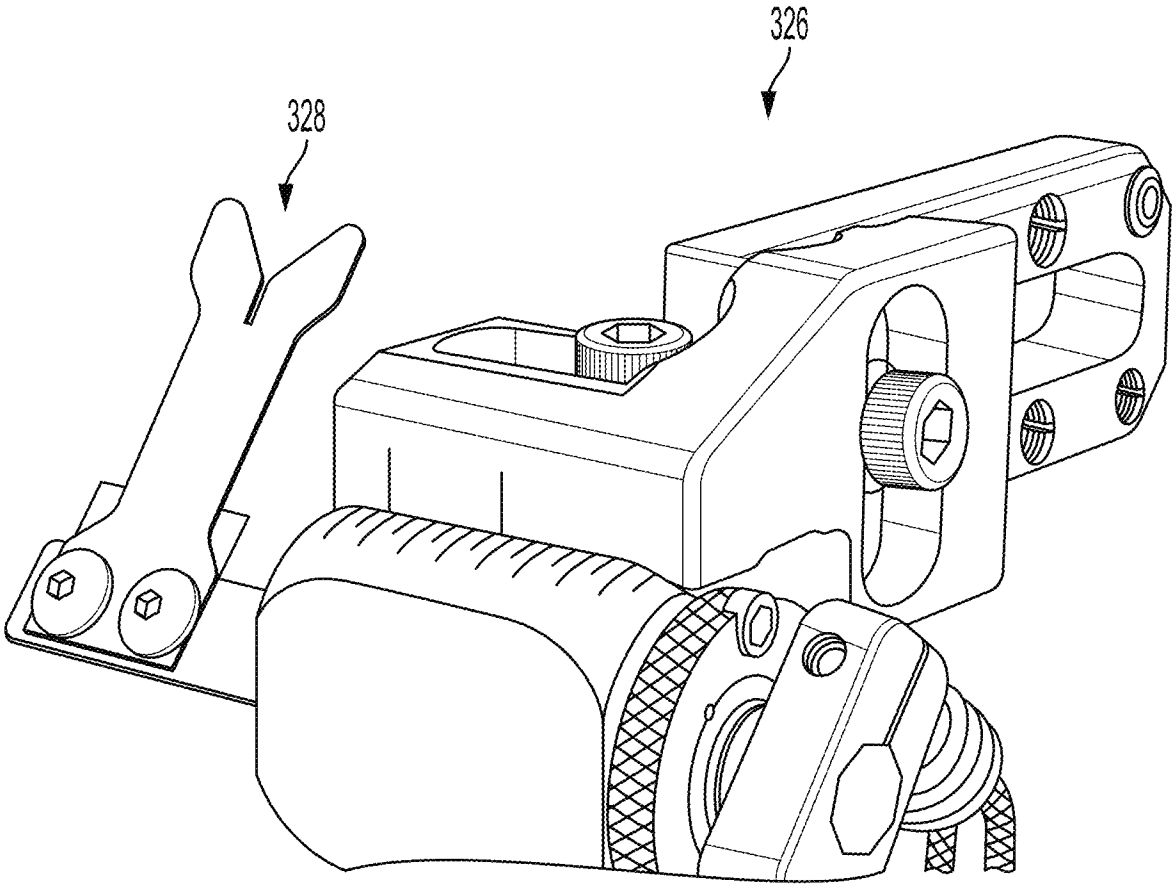
FIG. 24 is an isometric view of another arrow rest assembly for which an embodiment of the archery accessory guard is configured to at least partially surround and guard.
Figure 25:
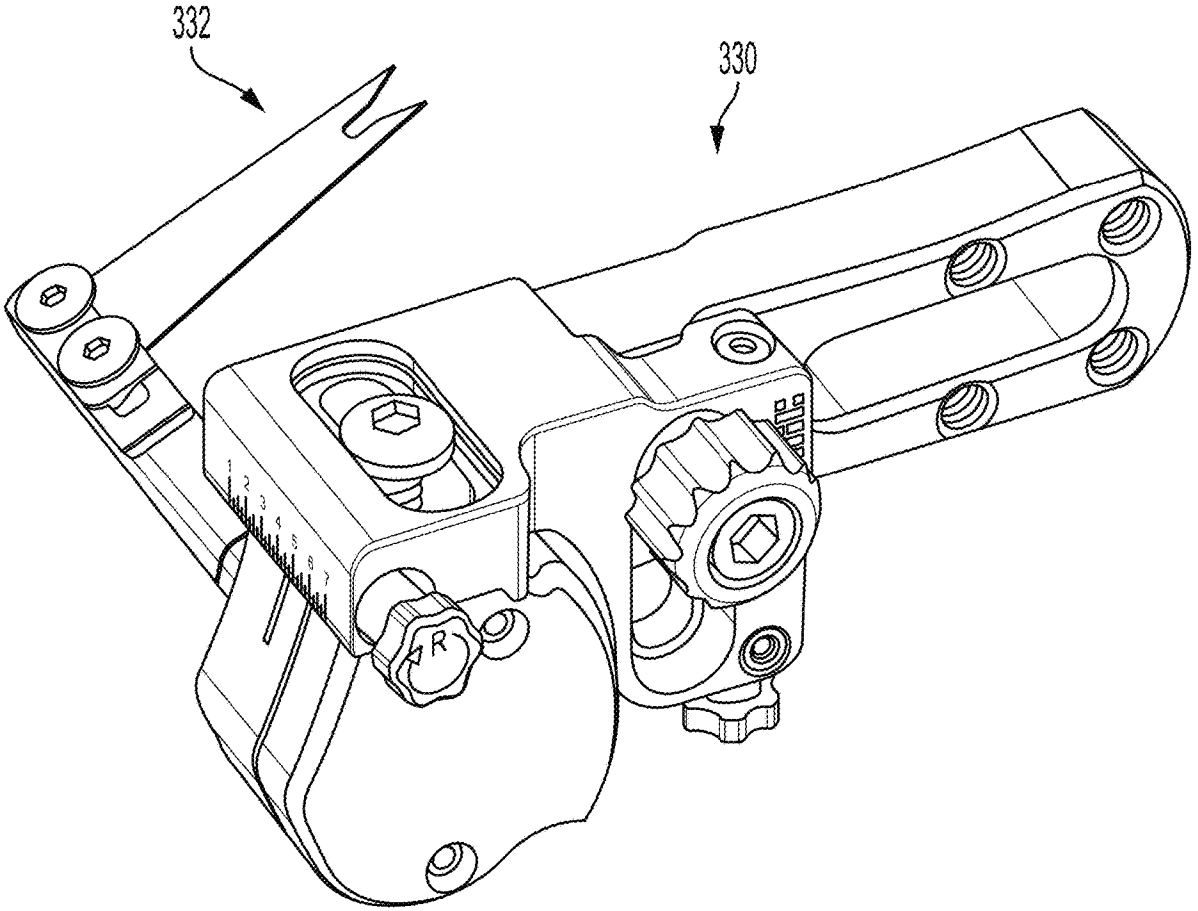
FIG. 25 is an isometric view of yet another arrow rest assembly for which an embodiment of the archery accessory guard is configured to at least partially surround and guard.
Figure 26:
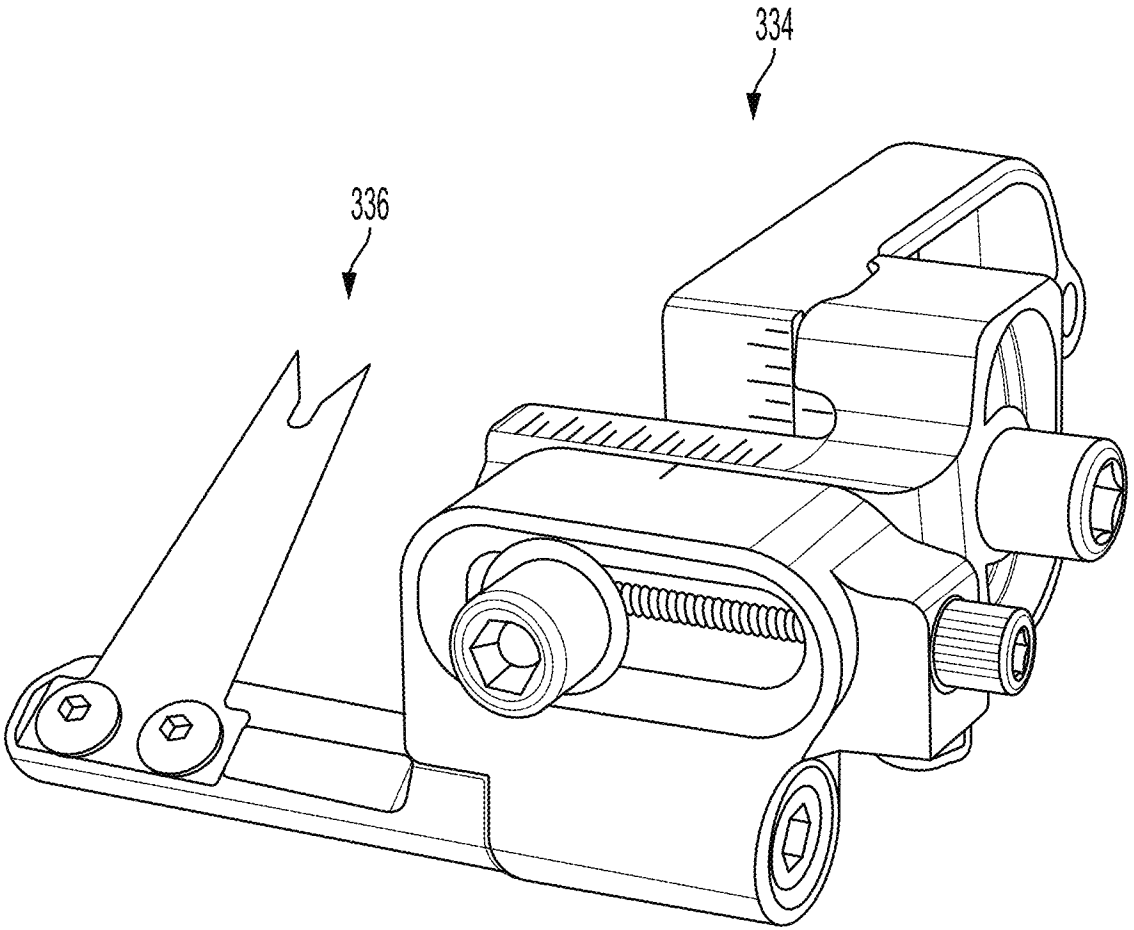
FIG. 26 is an isometric view of still another arrow rest assembly for which an embodiment of the archery accessory guard is configured to at least partially surround and guard.

It should be understood that the archery accessory elements of certain types of arrow rest assemblies are arrow rest blades. Arrow rest blades are often used in archery competitions and tournaments. Arrow rest blades can be constructed of relatively thin sheets of metal with relatively sharp edges, corners and points, posing a safety hazard to people and objects that might come into contact with the blades. In an embodiment, each of the accessory guards 4, 17, 110, 210 is configured to be removably attached to a variety of different types of arrow rest assemblies that have arrow rest blades, such as the arrow rest assemblies 326, 330, 334 having accessory elements 328, 332, 336, respectively, that include arrow rest blades as illustrated in FIGS. 24, 25 and 26, respectively.

As described above, each of the archery accessory guards 4, 17, 110, 210 is configured to function as a partial or full cover for the accessory element 8, 19, 112, 312, 316, 320, 324, 328, 332, 336. In this way, each of the accessory guards 4, 17, 110, 210 has a role as a removable, protective cover, guard or protector for the accessory element 8, 19, 112, 312, 316, 320, 324, 328, 332, 336.

Depending on the embodiment, each of the accessory guards 4, 17, 110, 210 can be removably or reversibly coupled to a weapon, weapon accessory or archery accessory through a variety of different coupling devices or methods, including, a press fit coupling method, a snap fit coupling method, a friction fit coupling method, one or more magnetic elements, an adhesive element, or a fastener, such as a screw, bolt, clip or pin.

In an embodiment, each of the accessory guards 4, 17, 110, 210 is configured to mate with a support 6, 13, 172. In an embodiment, to transition from a non-mated position to a mated position, the accessory guard 4, 17, 110, 210 flexes and expands, thereby applying a spring force to the support 6, 13, 172. In another embodiment, to transition from a non-mated position to a mated position, the support 6, 13, 172 flexes and expands, thereby applying a spring force to the accessory guard 4, 17, 110, 210.

Additional embodiments include any one of the embodiments described above, where one or more of its components, functionalities or structures is interchanged with, replaced by or augmented by one or more of the components, functionalities or structures of a different embodiment described above.

The parts, components, and structural elements of each of the accessory guards 4, 17, 110, 210 can be combined into an integral or unitary, one-piece object through welding, soldering, plastic molding other methods, or such parts, components, and structural elements can be distinct, removable items that are attachable to each other through screws, bolts, pins and other suitable fasteners. For example, each of the accessory guards 4, 17, 110, 210 can be a single-piece, unitary structure. In another example, the coupler, body and blocker of each of the accessory guards 4, 17, 110, 210 can be separate components connected together by suitable fasteners.

In an embodiment, each of the accessory guards 4, 17 is a weaponry accessory guard. In such embodiment, each of the accessory elements 8, 19 is a weapon accessory element, and the weapon 2 is a non-archery weapon, such as a rifle, handgun or other type of firearm.

In the foregoing description, certain components or elements may have been described as being configured to mate with each other. For example, an embodiment may be described as a first element (functioning as a male) configured to be inserted into a second element (functioning as a female). It should be appreciated that an alternate embodiment includes the first element (functioning as a female) configured to receive the second element (functioning as a male). In either such embodiment, the first and second elements are configured to mate with, fit with or otherwise interlock with each other. For example, the male-female relationship of the rotation inhibitor 176 and the slot 173 can be switched so that the rotation inhibitor 176 is converted to a slot, and the slot 173 is converted to a protrusion or notch.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

Additional embodiments include any one of the embodiments described above, where one or more of its components, functionalities or structures is interchanged with, replaced by or augmented by one or more of the components, functionalities or structures of a different embodiment described above.

The following is claimed:

1. An archery accessory guard comprising:

a coupler configured to be removably attached to a support, wherein the support comprises one of: (a) a portion of an archery accessory other than an archery accessory element; or (b) a weapon portion other than the archery accessory element; and a body coupled to the coupler, wherein the body is configured to at least partially guard the archery accessory element, wherein the archery accessory element comprises a front element face, a rear element face, a plurality of element sides, and an element part, wherein the body comprises a first guard surface configured to at least partially face toward at least one of the front element face or the rear element face, wherein the body comprises a second guard surface configured to at least partially cover the element part, wherein, the coupler and the body are configured so that, when the coupler is coupled to the support:

the body at least partially obstructs access to the archery accessory element;

the body is configured to receive a force directed toward the element part; and the body is configured to transmit the force to the support, wherein the coupler is configured to flex to establish a press fit coupling to the support.

2. The archery accessory guard of claim 1, wherein the coupler and the body are configured so that, when the coupler is coupled to the support, the body is at least partially spaced apart from the archery accessory element by a gap.

3. The archery accessory guard of claim 1, wherein:

the support comprises a part of one of an arrow rest assembly or an archery bow;

the body is configured to at least partially guard an arrow holder of the arrow rest assembly; and the element part comprises an arrow engagement surface of the arrow holder.

4. An archery accessory guard comprising:

a coupler configured to be removably attached to a support, wherein the support comprises one of: (a) a portion of an archery accessory other than an archery accessory element; or (b) a weapon portion other than the archery accessory element; and a body coupled to the coupler, wherein the body is configured to at least partially guard the archery accessory element that comprises a front element face, a rear element face, a plurality of element sides, and an element part, wherein the body comprises a first guard surface configured to at least partially face toward at least one of the front element face or the rear element face, wherein the body comprises a second guard surface configured to at least partially cover the element part, wherein, the coupler and the body are configured so that, when the coupler is coupled to the support:

the body at least partially obstructs access to the archery accessory element;

the body is configured to receive a force directed toward the element part; and the body is configured to transmit the force to the support, wherein the support comprises a support mating member, wherein the coupler comprises a coupler mating member configured to mate with the support mating member.

5. The archery accessory guard of claim 4, wherein:

the force is caused by an object; and the coupler and the body are configured so that, when the coupler is coupled to the support, the body is configured to block the object from reaching the element part while the first guard surface is one of: (a) spaced apart from one of the front element face or the rear element face; or (b) in physical contact with one of the front element face or the rear element face.

6. The archery accessory guard of claim 4, wherein: the coupler and the body are configured so that, when the coupler is coupled to the support, the second guard surface is spaced apart from the element part by a gap.

7. The archery accessory guard of claim 4, wherein:

the support comprises a part of one of an arrow rest assembly or an archery bow;

the body is configured to at least partially guard an arrow holder of the arrow rest assembly; and the element part comprises an arrow engagement surface of the arrow holder.

8. An archery accessory guard comprising:

a coupler configured to be removably attached to a support, wherein the support comprises one of: (a) a portion of an archery accessory other than an archery accessory element; or (b) a weapon portion other than the archery accessory element; and a body coupled to the coupler, wherein the body is configured to at least partially guard the archery accessory element that comprises an element bottom, a front element face, a rear element face, a plurality of element sides, and an element top that comprises an arrow engagement surface, wherein the body comprises a first guard surface configured to at least partially face toward at least one of the front element face or the rear element face, wherein the body comprises a second guard surface configured to at least partially cover the arrow engagement surface, wherein, the coupler and the body are configured so that, when the coupler is coupled to the support:

the body at least partially obstructs access to the archery accessory element;

the body is configured to receive a force directed toward the arrow engagement surface; and the body is configured to transmit the force to the support, wherein, when the coupler and the archery accessory element are each coupled to the support, the body is configured to transmit all of the force to the support.

9. The archery accessory guard of claim 8, wherein:

the archery accessory element comprises an arrow holder;

the arrow holder comprises a blade;

the arrow engagement surface comprises an edge of the blade; and the coupler and the body are portions of a single, unitary object.

10. An archery accessory guard comprising:

a coupler configured to be removably attached to a support, wherein the support comprises one of: (a) a portion of an archery accessory other than an archery accessory element; or (b) a weapon portion other than the archery accessory element; and a body coupled to the coupler, wherein the body is configured to at least partially guard the archery accessory element that comprises a front element face, a rear element face, a plurality of element sides, and an element part, wherein the body comprises a first guard surface configured to at least partially face toward at least one of the front element face or the rear element face, wherein the body comprises a second guard surface configured to at least partially cover the element part, wherein, the coupler and the body are configured so that, when the coupler is coupled to the support:

the body at least partially obstructs access to the archery accessory element;

the body is configured to receive a force directed toward the element part; and the body is configured to transmit the force to the support, wherein the archery accessory element is associated with:

an active mode in which the archery accessory element performs an archery function related to an archery activity; and an inactive mode corresponding to a non-archery activity, wherein the archery accessory guard is configured to be attached to the support to safeguard the element part during the inactive mode, wherein the archery accessory guard is configured to be detached from the support to increase access to the element part during the active mode.

11. The archery accessory guard of claim 10, wherein:

at least one of the coupler and the body comprises an activity interference member configured to interfere with the archery activity during the inactive mode; and the coupler and the body are configured so that, when the coupler is coupled to the support, the body is at least partially spaced apart from the archery accessory element by a gap.

12. The archery accessory guard of claim 10, wherein:

the support comprises a part of one of an arrow rest assembly or an archery bow;

the body is configured to at least partially guard an arrow holder of the arrow rest assembly; and the element part comprises an arrow engagement surface of the arrow holder.

13. An archery accessory guard comprising:

a coupler that is configured to be removably attached to a support through a press fit securement, wherein the support comprises one of: (a) a portion of an archery accessory other than an archery accessory element; or (b) a weapon portion other than the archery accessory element; and a body coupled to the coupler, wherein the body is configured to at least partially guard the archery accessory element, the archery accessory element comprising a front element surface, a rear element surface, and an element part, wherein the body comprises a body surface configured to at least partially face toward at least one of the front element surface or the rear element surface, wherein, the coupler and the body are configured so that, when the coupler is coupled to the support:

the body is configured to receive a force directed toward the element part; and the body is configured to transmit the force to the support.

14. The archery accessory guard of claim 13, wherein:

the coupler and the body are configured so that, when the coupler is coupled to the support, the body is at least partially in physical contact with the archery accessory element;

the coupler is configured to mate with the support; and during the mating, the coupler compresses the support or is compressed by the support.

15. The archery accessory guard of claim 13, wherein the coupler and the body are configured so that, when the coupler is coupled to the support, the body is configured to transmit the force along a force transmission that initially flows from the body to the support before any of the force transmission flows to the element part.

16. The archery accessory guard of claim 13, wherein:

the force is caused by an object; and the coupler and the body are configured so that, when the coupler is coupled to the support: (a) the body is configured to block the object from reaching the element part while the body avoids physical contact with the element part; and (b) the body comprises one of: (i) a first position in which the body is at least partially in physical contact with the archery accessory element; or (ii) a second position in which the body is spaced apart from the archery accessory element by a gap.

17. The archery accessory guard of claim 13, wherein:

the coupler is configured to mate with a member that comprises part of one of the support or the archery accessory element; and during the mating, the coupler compresses the member or is compressed by the member.

18. The archery accessory guard of claim 13, wherein:

the support comprises a part of one of an arrow rest assembly or an archery bow;

the body is configured to at least partially guard an arrow holder of the arrow rest assembly; and the element part comprises an arrow engagement surface of the arrow holder.

19. A method for manufacturing an archery accessory guard, the method comprising:

configuring a coupler to be removably attachable, in a press fit fashion, to a support, wherein the support comprises one of: (a) a portion of an archery accessory other than an archery accessory element; or (b) a weapon portion other than the archery accessory element;

configuring a body to at least partially guard the archery accessory element, wherein the archery accessory element comprises a front element surface, a rear element surface, and an element part, wherein the body comprises a body surface configured to at least partially face toward at least one of the front element surface or the rear element surface; and coupling the body to the coupler, wherein, the coupler and the body are configured so that, when the coupler is coupled to the support:

the body is configured to receive a force directed toward the element part; and the body is configured to transmit the force to the support.

20. The method of claim 19, comprising configuring the coupler and the body so that, when the coupler is coupled to the support, the body is configured to transmit the force along a force transmission that initially flows from the body to the support before any of the force transmission flows to the element part.

21. The method of claim 19, wherein:

the force is caused by an object; and the method comprises configuring the coupler and the body so that, when the coupler is coupled to the support, the body is configured to block the object from reaching the element part while the body avoids physical contact with the element part.

22. The method of claim 19, comprising:

configuring the coupler to be removably attached to the support; and configuring the body so that, when the coupler is coupled to the support, the body comprises one of: (a) a first position in which the body is at least partially in physical contact with the archery accessory element; or (b) a second position in which the body is spaced apart from the archery accessory element by a gap.

23. The method of claim 19, wherein:

the support comprises a part of one of an arrow rest assembly or an archery bow;

the element part comprises an arrow engagement surface of an arrow holder of the arrow rest assembly; and the configuring of the body comprises configuring the body to at least partially guard the arrow holder of the arrow rest assembly.

24. An archery accessory guard comprising:

a coupler attachable to a support, wherein the support comprises one of: (a) a portion of an arrow rest assembly other than an arrow holder, wherein the arrow rest assembly comprises the arrow holder and a mount portion configured to secure the arrow rest assembly to an archery bow; or (b) a part of the archery bow other than the arrow holder; and a body coupled to the coupler, wherein the body is configured to at least partially guard the arrow holder, wherein the arrow holder comprises a front surface, a rear surface, and an arrow engagement surface, wherein the body comprises a body surface configured to at least partially face toward at least one of the front surface or the rear surface, wherein, the coupler and the body are configured so that, when the coupler is attached to the support:

the body is configured to move relative to the mount portion based on any movement of the support relative to the mount portion, the movement of the body causing the body to continue to at least partially face toward at least one of the front surface or the rear surface during any movement of the arrow holder relative to the mount portion;

the body is configured to receive a force directed toward the arrow engagement surface; and the body is configured to transmit the force to the support.

25. The archery accessory guard of claim 24, wherein:

the support comprises the portion of the arrow rest assembly; and the portion comprises an extension configured to at least partially rotate relative to the archery bow.

26. The archery accessory guard of claim 24, wherein, when the coupler is attached to the support, the body comprises one of: (a) a first position in which the body is at least partially in physical contact with the arrow holder; or (b) a second position in which the body is spaced apart from the arrow holder by a gap.

27. The archery accessory guard of claim 24, wherein:

the arrow holder comprises a blade;

the arrow engagement surface comprises an edge of the blade; and the coupler and the body are portions of a single, unitary object.

28. The archery accessory guard of claim 24, wherein:

the support comprises a tubular shape;

the coupler is configured to at least partially receive the support; and the coupler is configured to flex to establish a press fit securement to the support.

29. The archery accessory guard of claim 24, wherein:

the support comprises a tubular shape comprising a first diameter;

the coupler is flexible to comprise a diameter that varies between:

(a) a second diameter that is less than the first diameter; and (b) a third diameter that is greater than the first diameter.

30. The archery accessory guard of claim 24, wherein the coupler comprises an elastic characteristic configured to secure the coupler to the support.

31. The archery accessory guard of claim 24, wherein the coupler comprise a rotation inhibitor.

32. An archery accessory guard comprising:

a coupler configured to be removably attached to a support, wherein the support comprises one of: (a) a portion of an archery accessory other than an archery accessory element; or (b) a weapon portion other than the archery accessory element; and a body coupled to the coupler, wherein the body is configured to at least partially guard the archery accessory element that comprises a front element face, a rear element face, a plurality of element sides, and an element part, wherein the body comprises a first guard surface configured to at least partially face toward at least one of the front element face or the rear element face, wherein the body comprises a second guard surface configured to at least partially cover the element part, wherein, the coupler and the body are configured so that, when the coupler is coupled to the support:

the second guard surface at least partially covers the element part;

the body at least partially obstructs access to the archery accessory element;

the body is configured to receive a force directed toward the element part; and the body is configured to transmit the force to the support, wherein a segment of the coupler conforms to a geometry of the support, wherein the support comprises a part of one of an arrow rest assembly or an archery bow;

wherein the body is configured to at least partially guard an arrow holder of the arrow rest assembly; and wherein the element part comprises an arrow engagement surface of the arrow holder.

* * * * *